US011292284B2

(12) United States Patent
Busam et al.

(10) Patent No.: US 11,292,284 B2
(45) Date of Patent: Apr. 5, 2022

(54) EXPANDABLE STORAGE DEVICE

(71) Applicant: ACCO Brands Corporation, Lake Zurich, IL (US)

(72) Inventors: Edward P. Busam, Mason, OH (US); Gary W. Chalmers, London (CA)

(73) Assignee: ACCO Brands Corporation, Lake Zurich, IL (US)

( * ) Notice: Subject to any disclaimer, the term of this patent is extended or adjusted under 35 U.S.C. 154(b) by 0 days.

(21) Appl. No.: 16/917,418

(22) Filed: Jun. 30, 2020

(65) Prior Publication Data

US 2021/0402823 A1 Dec. 30, 2021

(51) Int. Cl.

| | |
|---|---|
| ***B42F 13/38*** | (2006.01) |
| ***B42F 13/00*** | (2006.01) |
| ***B42F 13/16*** | (2006.01) |

(52) U.S. Cl.

CPC ..... *B42F 13/38* (2013.01); *B42F 13/0033* (2013.01); *B42F 13/16* (2013.01)

(58) Field of Classification Search

CPC ..... B42F 13/38

See application file for complete search history.

(56) References Cited

U.S. PATENT DOCUMENTS

| | | | | |
|---|---|---|---|---|
| 2,099,472 A | | 11/1937 | Emery | |
| 2,784,719 A | | 3/1957 | Panfil | |
| 2,832,349 A | * | 4/1958 | Frank | B42F 13/12 402/50 |
| 3,111,126 A | | 11/1963 | Brinkmann | |
| 3,785,740 A | | 1/1974 | Strong | |
| 3,972,632 A | | 8/1976 | Carter | |
| 4,990,017 A | * | 2/1991 | Rotherham | B42F 13/22 402/502 |

(Continued)

FOREIGN PATENT DOCUMENTS

| | | | |
|---|---|---|---|
| DE | 202017107680 | 1/2018 | |
| GB | 190910800 A * | 12/1909 | B42F 13/00 |

(Continued)

OTHER PUBLICATIONS

"Charles Leonard Expandable Varicap Binder, Expandable to 1500 Sheets, 8.5 x 11 Inches, Black (61601)," available at https://www.amazon.com/Charles-Leonard-Expandable-Varicap-61601/dp/B0006HWLYK/, accessed on Feb. 18, 2020 (13 pages).

*Primary Examiner* — Kyle R Grabowski

(74) *Attorney, Agent, or Firm* — Fitch, Even, Tabin & Flannery LLP

(57) ABSTRACT

An expandable storage device is provided including a first panel and a second panel, along with one or more mechanisms for adjusting the size of a spine therebetween. By one approach, the storage device includes a first panel having a first panel spine portion, a second panel having a second panel spine portion, and one or more actuators, where the first panel spine portion and the second panel spine portion are configured to form a spine of the device having an adjustable width. The one or more actuators may be configured to move between an unlocked and a locked configuration to move the first panel or the second panel relative to one another and selectively retain the spine of the device at variety of adjustable widths. So configured, the device may accommodate an increasing or decreasing number of articles, sheets, or other items placed therein.

19 Claims, 21 Drawing Sheets

(56) References Cited

U.S. PATENT DOCUMENTS

| | | | | | |
|---|---|---|---|---|---|
| 5,213,370 | A * | 5/1993 | Hood | B42D 3/00 281/29 |
| 5,222,825 | A | 6/1993 | Wyant | |
| 5,255,992 | A | 10/1993 | Nickow | |
| 5,474,332 | A | 12/1995 | Yeh | |
| 6,450,535 | B1 | 9/2002 | Shafer | |
| 9,352,606 | B2 * | 5/2016 | Merzon | B42F 13/38 |
| 2005/0104362 | A1 | 5/2005 | Kam | |
| 2012/0294669 | A1 | 11/2012 | Wrigley | |

FOREIGN PATENT DOCUMENTS

| | | | | | |
|---|---|---|---|---|---|
| GB | 191308399 | A | * | 4/1914 | B42F 13/00 |
| GB | 191509180 | A | * | 6/1916 | B42F 13/04 |
| GB | 148865 | A | * | 7/1921 | B42F 13/00 |
| GB | 218257 | A | * | 2/1925 | B42F 13/04 |
| GB | 423210 | A | * | 1/1935 | B42F 13/04 |
| GB | 498334 | A | * | 1/1939 | B42F 13/04 |
| GB | 513931 | A | * | 10/1939 | B42F 13/04 |
| WO | WO-2008018293 | A1 | * | 2/2008 | B42F 13/0006 |

* cited by examiner

EXPANDABLE STORAGE DEVICE

FIELD

This disclosure relates generally to storage devices and components, and more specifically, to expandable storage devices configured to move between one or more expanded configurations.

BACKGROUND

Storage devices or components such as binders, folders, notebooks and the like are known for storing articles such as loose-leaf papers, computer printouts, handouts, and other documents. For example, such devices may include a binding mechanism such as a three-ring binding for attaching various sheets or layers of articles within the device. The articles may be stored in the device so that they are easily accessible and transportable but may be readily accessed for viewing or removal when a cover of the device is open.

Many traditional binders or storage devices include a spine having a fixed or predetermined width such that the thickness of the binder is the same whether the binder contains only a few sheets or a large number of sheets. However, when additional sheets or documents are desired to be inserted or held in the binder, the spine can be of an inadequate width to properly accommodate the combined thickness of the sheets. In one example, a student may utilize a single binder for a specific class that requires a multitude of handouts, sheets, or other paper materials, and the width of the binder may be too small to accommodate same. As such, the student may need to purchase a larger binder, or an additional binder which may be inconvenient and expensive.

Some attempts have been made to improve storage devices so that they may be expanded to accommodate a varying number of articles or sheets and to permit the addition or removal of sheets as needed. For example, some known expansion mechanisms provide a general capability to increase the width of the spine of the device but are difficult or unintuitive to use. In some known expandable devices, the components permitting the expansion may be bulky and increase the profile of the device. In further examples, such devices may require the addition or replacement of various components in order to facilitate expansion thereof.

It would thus be desirable to provide an expandable storage device for accommodating an increasing number of articles (e.g., loose-leaf papers, additional items, etc.) stored therein having an improved and intuitive expansion mechanism.

DETAILED DESCRIPTION

Figure 1:
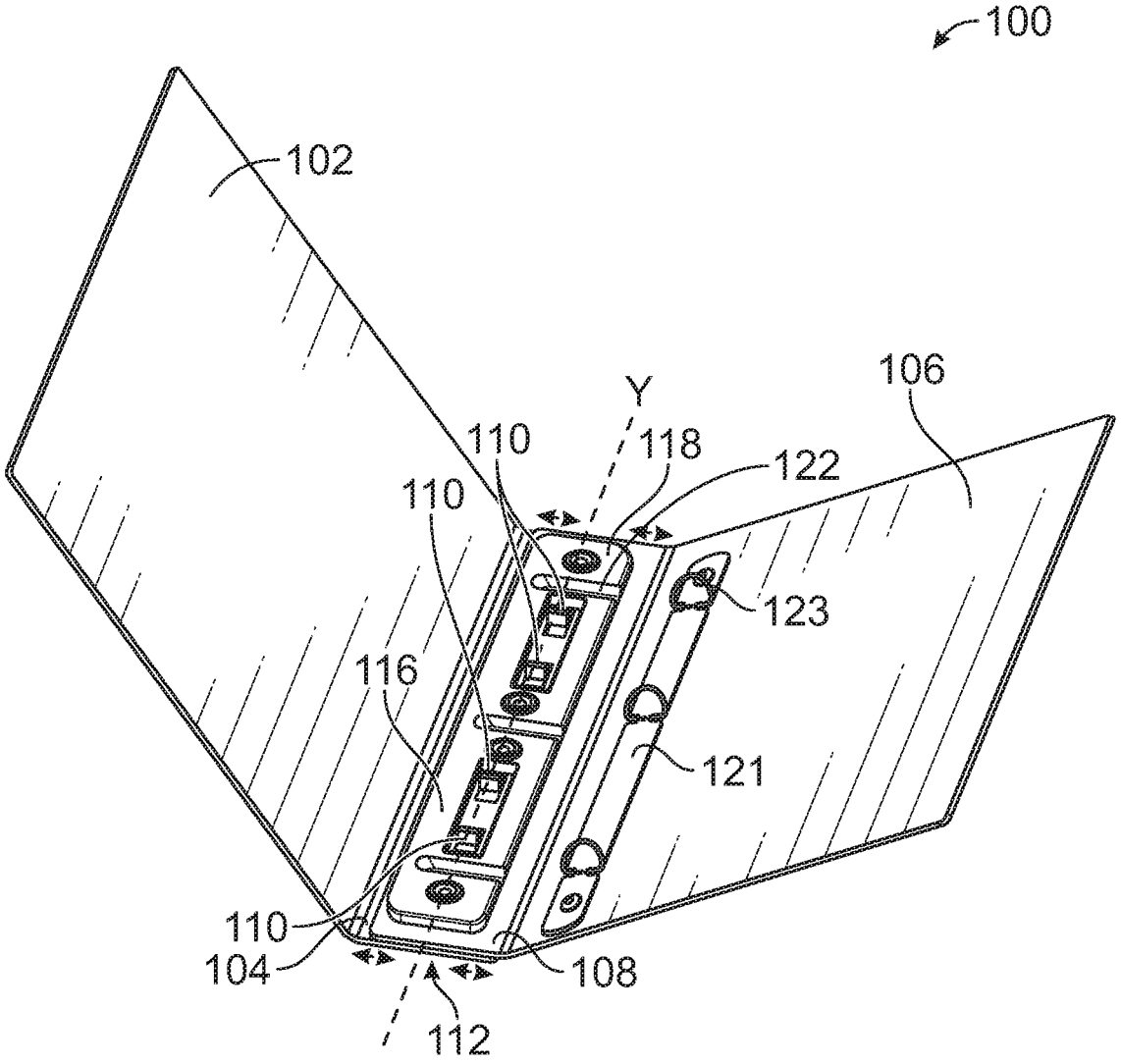
FIG. 1 is a perspective view of an example expandable storage device including a first panel having a first panel spine portion, a second panel having a second panel spine portion, and an expansion mechanism including a plurality of actuators positioned in a housing.

Generally speaking, described herein are systems, apparatuses, and methods to provide an expandable storage device and manner of assembling such a device that has a first panel and a second panel, along with one or more mechanisms for adjusting a width of the spine therebetween. Once assembled, such an expandable storage device permits a user to adjust the width of the spine via expansion or retraction to hold, for example, articles, papers, bound components, and/or other components stored in the device having varying thicknesses. Further, the adjustment of the storage device is conducted by intuitive, manual manipulation of one or more actuators. In operation, the actuators have portions that move corresponding portions of the spine to expand or retract a width of the spine when the actuators are moved, as described below.

In one illustrative configuration, an expandable storage device is provided including a first panel having a first panel spine portion, a second panel having a second panel spine portion, and one or more actuators. The first panel spine portion and the second panel spine portion are configured to form a spine having an adjustable width. The one or more actuators each include a distal projection configured to extend through one or more guide apertures of the first and second panel spine portions in an initial locked configuration. Upon movement of an actuator in an axial direction, the distal projection thereof is configured to at least partially engage with and slide along a guide surface of the guide aperture into an unlocked configuration such that the first panel or the second panel may be moved relative to one another to increase or decrease the width of the spine. The width of the spine may then be selectively secured in another locked configuration. So configured, the expandable storage device is able to accommodate an increasing number of articles, sheets, or other items placed therein.

In some forms, a plurality of actuators may be provided to permit adjustment of the spine between a plurality of different widths. Each actuator may include a body portion, a proximal projection for engagement by a user, a distal projection for engagement with a guide aperture, and resilient arm portions for biasing the distal projection into an initial configuration. The expandable storage device may include a first pair of actuators configured to cause movement of the first panel spine portion relative to the second panel spine portion to adjust the width of the spine, and a second pair of actuators configured to cause movement of the second panel spine portion relative to the first panel spine portion to adjust the width of the spine. In addition, movement of both pairs of actuators may be configured to increase the width of the spine to a width greater than either the first or second pairs of actuators alone. So configured, the spine of the expandable storage device may be selectively secured at a variety of desired widths.

Each guide aperture of the first panel spine portion and the second panel spine portion may include one or more leg portions corresponding with a desired expansion width that are configured to engage with and receive the distal projection of each actuator. As provided herein, the resilient arm portions of each actuator are configured to bias the distal projection thereof into a leg portion of the guide aperture to inhibit movement of the distal projection and retain the spine at a desired width. By moving the actuator in an axial direction, the resilient arm portions may be compressed and the distal projection of each actuator may be moved to a different selected leg portion to selectively secure the spine at a different expanded width corresponding with the selected leg portion. In some forms provided herein, the guide aperture may be heart-shaped, U-shaped, C-shaped, or may be formed of still other configurations.

In some embodiments, distal projections of the first pair of actuators may initially be engaged in guide apertures of the first panel. Movement of the first pair of actuators in opposing axial directions may be configured to move the distal projections into an unlocked configuration and cause the first panel to move relative to the second panel as the distal projections push against walls or surfaces of the guide apertures. A user may then slide the distal projections of the actuators into a selected leg portion of each guide aperture corresponding with a desired width of the spine by, for example, pulling on an edge of the first panel. Similarly, distal projections of the second pair of actuators may initially be engaged in guide apertures of the second panel. Movement of the second pair of actuators in opposing axial directions may be configured to move the distal projections into an unlocked configuration and cause the second panel to move relative to the first panel. A user may then slide the distal projections of the actuators into a selected leg portion of each guide aperture corresponding with a desired width of the spine by, for example, pulling on an edge of the second panel.

In further forms, another example expandable storage device is provided including a first panel having a first panel spine portion and a second panel having a second panel spine portion. The first and second panel spine portions may form a spine of the device having a width W, which is adjustable. The first panel may include one or more wing panels extending from the first panel. The first panel spine portion includes one or more first fastening members and each of the wing panels includes one or more second fastening members configured to mate with and engage the first fastening members. The second panel spine portion includes one or more apertures that are configured to be aligned with, and advanced over, the first fastening members of the first spine portion. So configured, the wing panels may be folded over to partially overlap or superimpose the second panel spine portion and the second fastening members may be coupled to the respective first fastening members to selectively retain the spine at a desired width. If a different width is desired, the user may decouple the first and second fastening members, select a different aperture of the second panel spine portion to align therewith, and recouple first and second fastening member accordingly.

In still further embodiments, an expandable storage device may be provided including a first panel having a first panel spine portion and a second panel having a second panel spine portion. The first and second panel spine portions may form a spine of the device having a width W, which is adjustable. The first panel may include wing panels extending from the first panel spine portion. The first panel spine portion includes one or more first fastening members and each of the wing panels includes one or more second fastening members configured to mate with and engage the first fastening members. In some forms, the second panel spine portion includes an attachment flap having a plurality of apertures extending therethrough, and one or more securing flaps having slots that are slidably coupled to the first panel spine portion to permit the second panel to slide relative to the first panel up to a predetermined width.

By one approach, the attachment flap of the second panel spine portion may include one or more apertures that are configured to be aligned with, and advanced over the first fastening members of the first panel spine portion such that the wing panels may be folded over to at least partially overlap the second panel spine portion and the second fastening members may be coupled to the respective first fastening members to selectively retain the spine at a desired width. If a different width of the spine is desired, the user may decouple the first and second fastening members, select a different aperture of the attachment flap corresponding with a desired width, slide the securing flaps along the slots to align the selected aperture with the first fastening member, and then recouple first and second fastening members accordingly.

In yet another embodiment, an expandable storage device may include a first panel, a second panel, and a spine member forming a spine that is fixedly coupled to the first panel and movably or slidably engaged with the second panel to permit expansion of the spine. The spine member may be formed of a variety of materials and may extend through an elongate aperture or slot of the second panel such that the spine member may slide therethrough. The spine member includes an attachment portion extending from the second panel opposite the spine. In some instances, a user may desire a spine having a larger width to accommodate a larger number of articles such as loose-leaf paper within the expandable storage device. To do so, the user may slide the spine member relative to the second panel to increase the width of the spine and correspondingly decrease a width of the attachment portion.

In still another embodiment, an expandable storage device includes a first panel, a second panel, and a spine, and may be formed as a binder having a three-ring binding mechanism. The three-ring binding mechanism may be positioned on one or more of the first panel, the second panel, and the spine. The first panel may include a flex area configured to partially flex over and superimpose the three-ring binding mechanism when the number of articles contained in the binder is minimal such that the contour of the flex area generally corresponds with a contour of the rings of the three-ring binding mechanism. One or more straps may be used to retain the first panel in a generally L-shaped flexed configuration. As the user progressively adds additional articles or sheets within the binder, the flex area of the first panel may be configured to flex less such that the flex area does not wrap around as much of the three-ring binding mechanism and be secured by the one or more straps at a variety of different widths. So configured, the expandable storage device may be capable of be being selectively secured at any number of desired widths.

Referring now to the drawings, and more particularly FIG. 1, an example expandable storage device 100 is illustrated as a three-ring binder including a first panel 102 having first panel spine portion 104, a second panel 106 having second panel spine portion 108, and a plurality of actuators 110, where the first panel spine portion 104 and the second panel spine portion 108 are configured to form a spine 112 of the device 100 having an adjustable width. The first and second panels 102, 106 may be configured to move or rotate between an open binder configuration and a closed binder configuration in a known manner. In some forms, the first and second panels 102, 106 may be formed of a plastic or polymer material. Each of the actuators 110 includes a distal projection 134 (shown in FIGS. 4-8) configured to engage with one or more apertures of the first panel spine portion 104 and the second panel spine portion 108 to permit expansion of the spine 112 as described in further detailed hereinafter. As illustrated, the actuators 110 are aligned along a longitudinal axis Y and are positioned in a housing 116 of the device 100. The housing 116 may be formed of an upper portion 118 and a lower portion 120 (shown in FIG. 2).

For ease of reference, the actuators 110 nearest to the center of the spine 112 along the longitudinal axis Y may be referred to hereinafter as the "inner pair" and the actuators 110 furthest from the center of the spine 112 may be referred to as the "outer pair." However, it should be understood that the adjustment mechanism described herein may be performed using only a single actuator, or a plurality of actuators, and various pairs of actuators may be used in connection with one another to facilitate expansion of the device 100. Each actuator 110 includes a proximal surface or projection that may be engaged by a user (e.g., by a user's finger) to move the actuator 110 in an axial direction along the longitudinal axis Y. Although the actuators are illustrated extending from the inner, cover, or upper portion 118 of the housing 116, in other forms, the actuators may extend from the outer, base, or lower portion 120 of the housing 116 such that the actuators 110 may be positioned on an outer surface of the spine 112 when the device 100 is in a closed configuration.

The expandable storage device 100 may include a binding mechanism 121 to couple the papers, bound components, folders, or other articles to the device 100. In some configurations, the binding mechanism 121 is coupled to either of the first panel 102 or the second panel 106. In still other configurations, a binding mechanism such as binding mechanism 121 may be coupled to each of the first and second panels 102, 106, or each panel 102, 106 may include a different binding mechanism, such that the device 100 may be configured to accommodate additional articles or sheets upon expansion of the spine 112. As shown, in some configurations, the binding mechanism 121 is a three-ring binding attached to the second panel 106 that is configured to receive various articles such as loose-leaf sheets of paper. Although not illustrated, it should be understood that either or both of the first and second panels may include one or more pockets or other similar mechanisms configured to receive and/or retain selected documents or other articles as desired by the user such that expansion of the spine 112 may be desired to accommodate same. Further, the expandable storage device 100 is illustrated and described in the form of a binder having a three-ring binding mechanism, but it should be understood that the spine adjustment mechanism provided herein could be utilized in a variety of different components including books, filers, notebooks, dividers, folders, composition books, and the like. In some alternative forms, the binding mechanism 121 may be formed as a spiral binding, or other binding mechanisms known in the art.

In operation, a width of the spine 112 of the expandable storage device 100 may be adjusted and moved between, and selectively retained at, a variety of different widths to accommodate articles and contents of varying number and/or thickness. In order to expand and retract the spine 112 between these widths, a user may actuate one or more of the actuators 110 either alone or in combination. For example, as described further below with respect to FIGS. 9-11, upon actuation of just the outer pair of actuators 110 or a portion thereof, such as the distal projections 134, may cause the first panel 102 to move relative to the second panel 106 to expand the width of the spine 112 by a first amount. Alternatively, actuation of the inner pair of actuators 110 may cause the second panel 106, such as via the distal projections 134, to move relative to the first panel to expand the width of the spine 112 by a second amount. Such actuations may be performed either individually or in combination to expand or retract the width of the spine 112 and selectively retain the spine 112 at a variety of different widths. In alternative forms, an upper pair of actuators 110 may be configured to facilitate one adjustment operation and a lower pair of actuators may be configured to facilitate another adjustment operation. In still further forms, each actuator may be configured to facilitate an independent adjustment operation.

Figure 2:
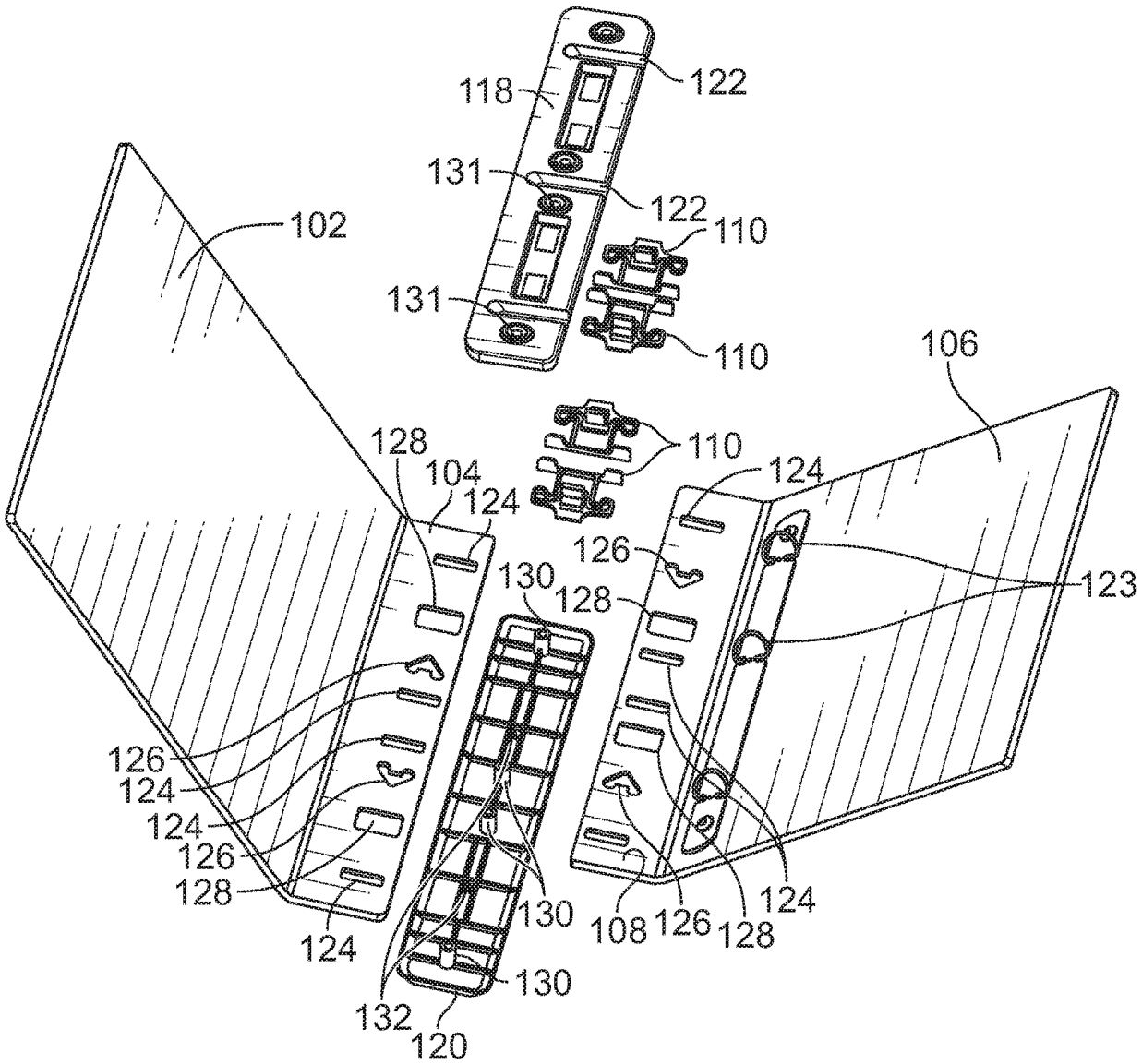
FIG. 2 is an exploded view of the expandable storage device of FIG. 1 showing the various components thereof.

As shown in FIG. 2, the upper portion 118 of the housing 116 may include cut-outs or depressions 122 corresponding with the shape of the binding mechanism 121 such that the binding mechanism does not otherwise interfere with or inhibit proper closure of the binder. For example, as shown the three-ring binding may include rings 123, (FIG. 1) which might contact the upper portion 118 of the housing 116 when the binder is in a closed configuration. In some forms, the rings 123 of the binding mechanism 121 may be sized to accommodate a varying number of sheets/articles (e.g., by utilizing rings having a smaller or larger circumference). In order to accommodate the three-ring binding mechanism, the depressions 122 of the housing may be included such that the rings 123 of the three-ring bindings may be nested therein when the device 100 is in a closed configuration. So configured, the depressions 122 may permit larger three-ring binding mechanisms having larger rings to be used that may improve or increase storage capacity while not interfering with closure of the device 100.

FIG. 2, which illustrates an exploded view of the expandable storage device 100 of FIG. 1, shows the upper portion 118 and the lower portion 120 of the housing 116 separate from one another such that the actuators 110 can be seen in more detail. In some configurations, each of the first and second panel spine portions 104, 108 includes a plurality of cut-outs or apertures extending therethrough having a variety of shapes. For example, each of the first and second spine portions 104, 108 includes one or more slots 124, one or more guide apertures 126, and one or more relief apertures 128. As illustrated, each of the first and second panel spine portions 104, 108 includes two guide apertures 126, two relief apertures 128, and four slots 124.

The guide apertures 126 of the first panel spine portion 104 are positioned proximate the inner pair of slots 124 and are shown oriented in generally opposite directions along the longitudinal axis. Additionally, the relief apertures 128 are positioned proximate the outer pair of slots 124 on the first panel spine portion 104. In contrast, the guide apertures 126 of the second panel spine portion 108 are positioned proximate the outer pair of slots 124 and are shown oriented in generally opposite directions. Further, the relief apertures 128 of the second panel spine portion 108 are positioned proximate the inner pair of slots 124. So configured, this alternating configuration permits one guide aperture 126 of one panel to be aligned with a corresponding relief aperture 128 on the opposite panel and vice versa once the device is assembled, which facilitates the selective adjustment operations as described in further detail below.

Figure 8:
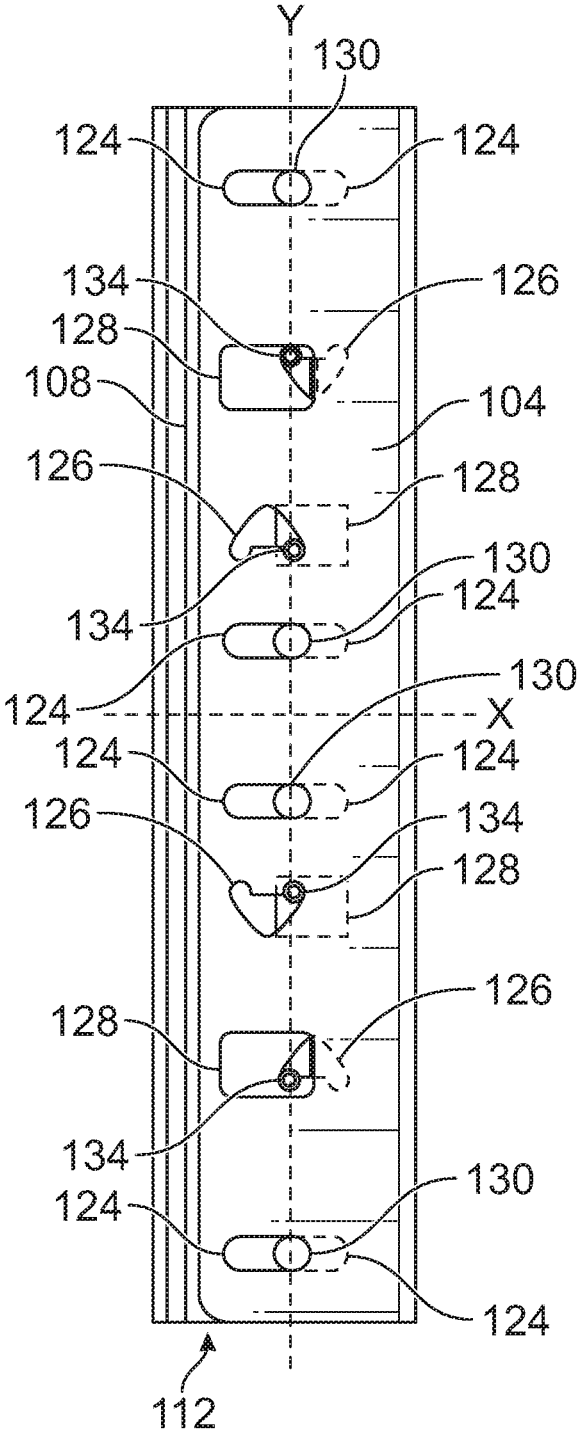
FIG. 8 is a plan view of the bottom of the spine of an example expandable storage device with the lower portion of the housing removed to show the first panel spine portion partially overlapping the second panel spine portion and illustrating the various apertures and slots, and the alignment thereof.

By one approach, the base or lower portion 120 of the housing 116 may include various support posts 130 extending vertically upward therefrom for coupling to the cover or upper portion 118 and limiting travel of the first and second panels in the lateral direction X (shown in FIG. 8). In some forms, the posts 130 may include a threaded aperture or bore therein such that a threaded fastener may be advanced through an opening 131 of the upper portion 118 of the housing 116 and into the threaded bore of the post 130 to secure the upper portion 118 to the lower portion 120. In alternative forms, the upper portion 118 may be coupled to the lower portion 120 via a removable or permanent screw, one or more force-fit components, glue, sonic welding, and the like. In addition, the lower portion 120 may include one or more reinforcement elements or guides 132 formed as, for example, two parallel walls or rails that are configured to confine a path of travel of actuators 110 along the longitudinal axis Y via engagement between guides 132 and a distal projection of the actuator 110.

Figure 3A:
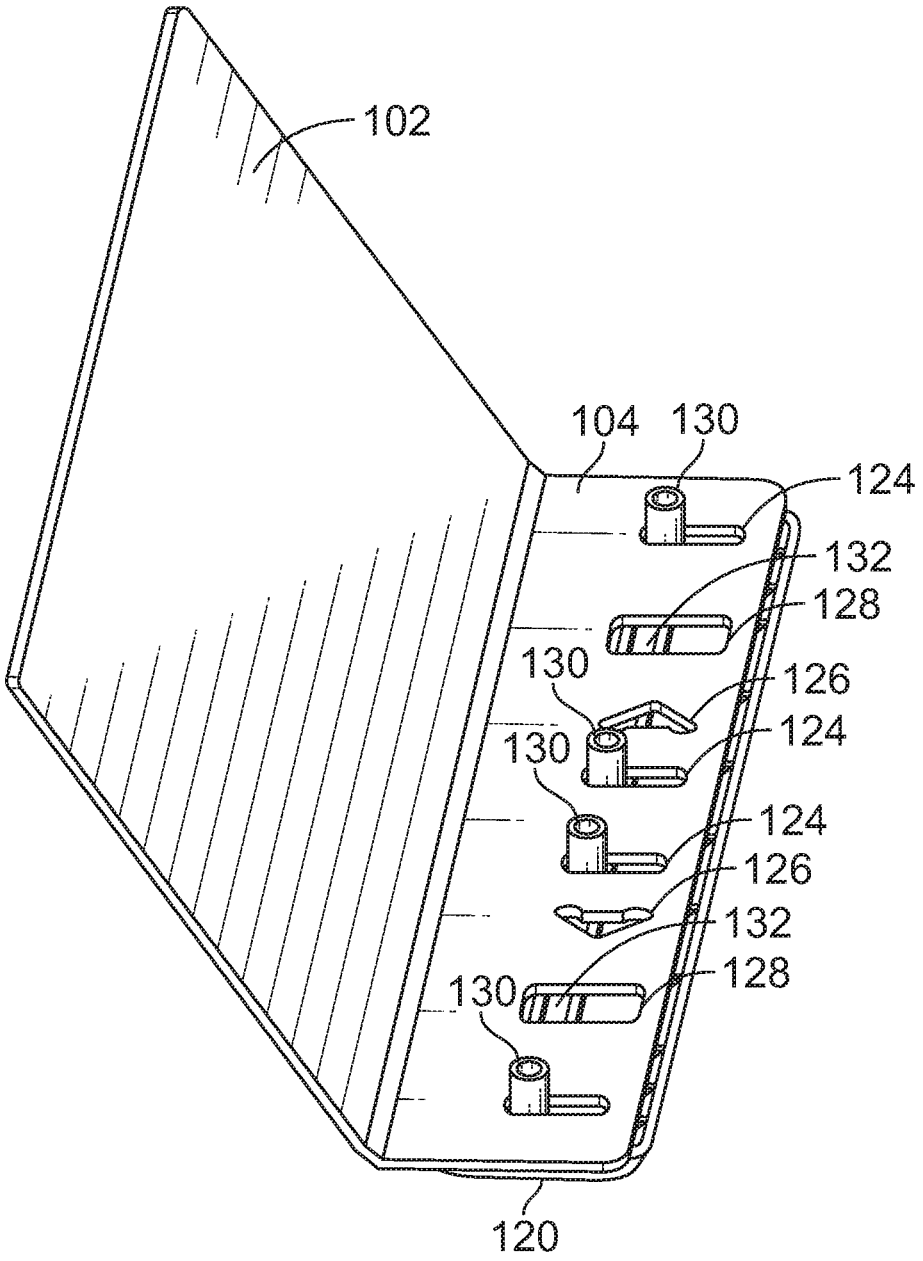
FIG. 3A is a perspective view of a first partial assembled configuration of an example expandable storage device showing slots of the first panel spine portion positioned over support posts extending from a lower portion of the housing.
Figure 3B:
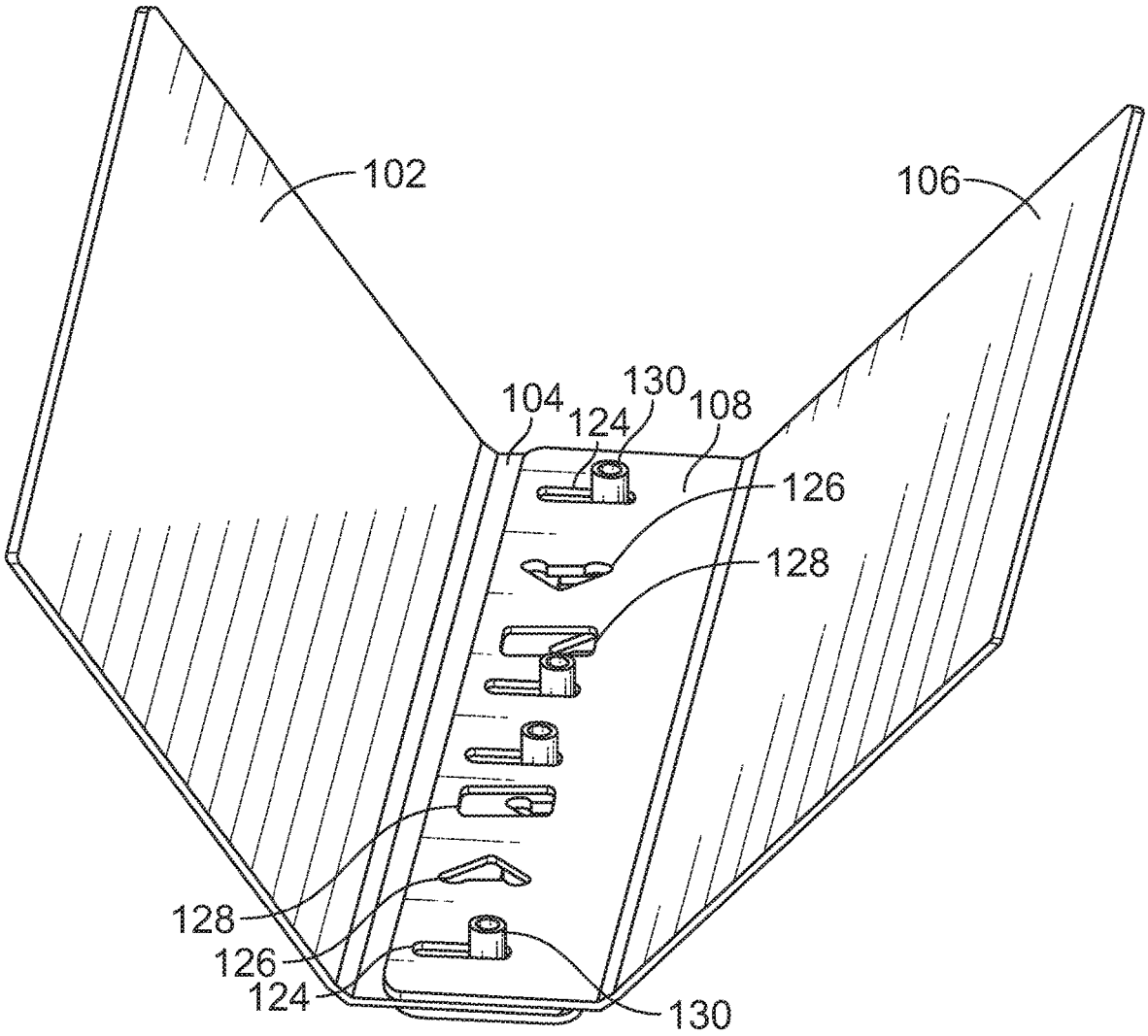
FIG. 3B is a perspective view of a second partial assembled configuration of an example expandable storage device showing slots of the second panel spine portion being advanced over the support posts.

FIGS. 3A-3D each illustrate exemplary partial assembled configurations, such that the figures depict potential steps for forming an expandable storage device 100 as shown in FIG. 1. In FIG. 3A, a first partial assembled configuration is shown illustrating the first panel 102 coupled to the base or lower portion 120 of the housing 116 with the one or more slots 124 in the first panel spine portion 104 advanced over corresponding support posts 130 of the lower portion 120. The guides 132 in the lower portion 120 may be seen through the apertures 126, 128. Then, in FIG. 3B, the second panel 106 may be similarly coupled to the lower portion 120 of the housing 116 by advancing the one or more slots 124 in the second panel spine portion 108 over the corresponding posts 130 such that the second panel spine portion 108 at least partially overlaps and superimposes the first panel spine portion 104. In this form, the posts 130 may permit sliding movement of either the first panel 102 or the second panel 106 along the length of the slots 124, but may limit the first and second panels 102, 106 from moving therepast. In addition, the guide apertures 126 of the second panel spine portion 108 are shown overlapping and generally aligned with the relief apertures 128 of the first panel spine portion 104, and vice versa, as described above.

Figure 3C:
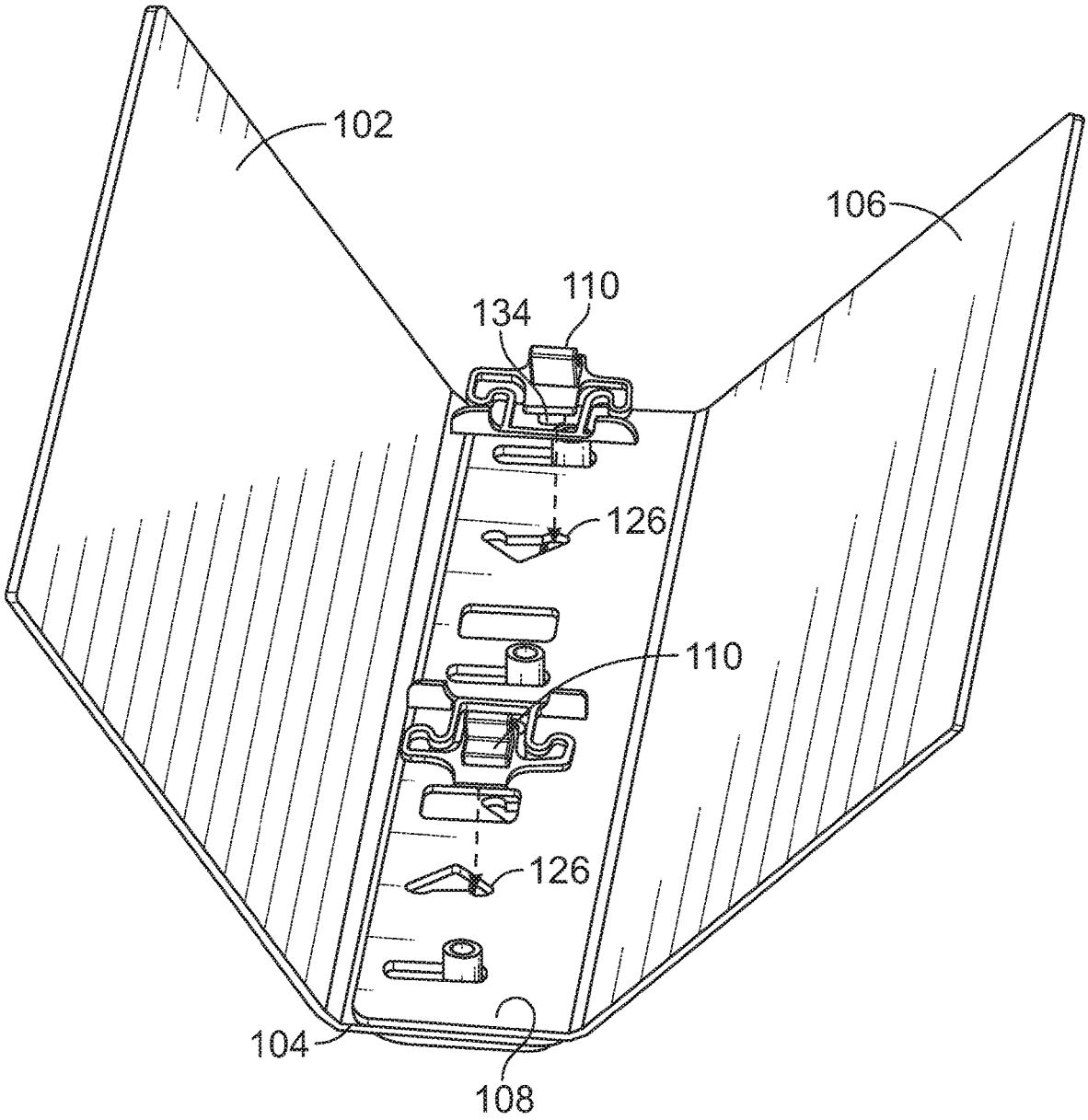
FIG. 3C is a perspective view of a third partial assembled configuration of an example expandable storage device showing a pair of actuators being engaged with heart-shaped guide apertures of the second panel spine portion by advancing a distal projection of the actuators therethrough.

As shown in FIG. 3C, each actuator 110 includes a distal projection 134 that is configured to be advanced through a respective combination of a guide aperture 126 in one of the panels and a relief aperture 128 in the other panel. For ease of illustration, only two actuators 110 are shown in FIG. 3C. In the illustrated form, the distal projections 134 of the two actuators 110 shown are being advanced through a respective guide aperture 126 of the second panel spine portion 108, through a respective relief aperture 128 of the first panel spine portion 104, and into the guide 132 of the lower portion 120 of the housing 116. Although not shown, the other two actuators 110 may be advanced through respective relief apertures 128 of the second panel spine portion 108, through respective guide apertures 126 of the first panel spine portion 104, and into the guide 132 of the lower portion 120 of the housing 116. So configured, each distal projection 134 extends through one guide aperture 126 of one panel and one relief aperture 128 of the other panel.

Figure 3D:
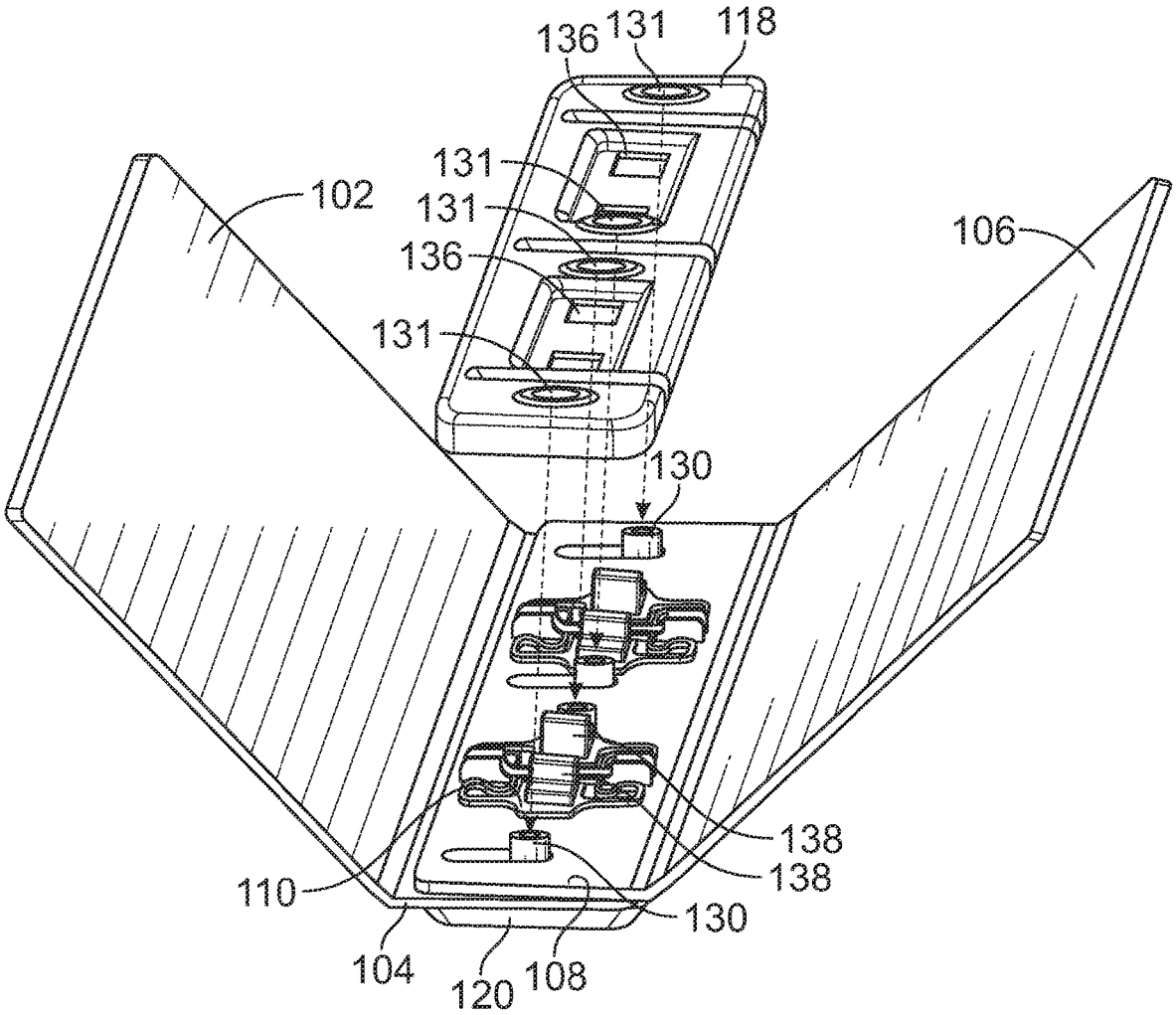
FIG. 3D is a perspective view of a fourth partial assembled configuration of an expandable storage device showing an upper portion of the housing being coupled to the support posts of the lower portion, the upper portion permitting a proximal projection of each actuator to extend through an opening thereof for actuation by a user.

As shown in FIG. 3D, the openings 131 of the cover or upper portion 118 of the housing 116 may be axially aligned with the support posts 130 of the lower portion 120 and may be coupled thereto. For example, a fastener such as a screw, bolt, snap, rivet, or the like may be used to couple the upper portion 118 to the lower portion 120 to form the housing 116. The upper portion 118 further includes one or more openings or slots 136 corresponding with the one or more actuators 110 such that a tab, proximal surface, or projection 138 of each actuator 110 may extend upward through a slot 136 of the housing 116 for engagement by a user. The combination of the slots 136 in the upper portion 118 and the guides 132 in the lower portion 120 of the housing 116 generally confine the one or more actuators 110 along a linear path of travel along the longitudinal axis Y (FIG. 1). In other forms, the device 100 need not be assembled in the example sequential steps shown in FIGS. 3A-3D, and may instead be assembled in a reverse order, or in other orders as desired.

Figure 4A:
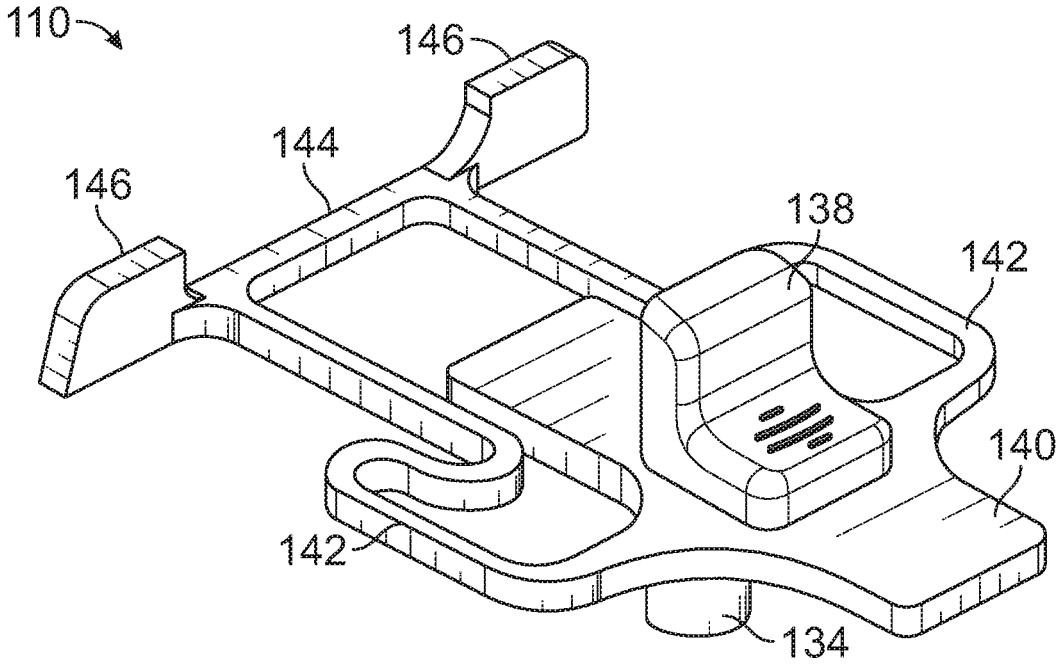
FIG. 4A is a perspective view of an example actuator having a body portion, two resilient arm portions, a foot portion, a proximal projection extending from a proximal surface of the body portion, and a distal projection extending from a distal surface of the body portion.
Figure 4B:
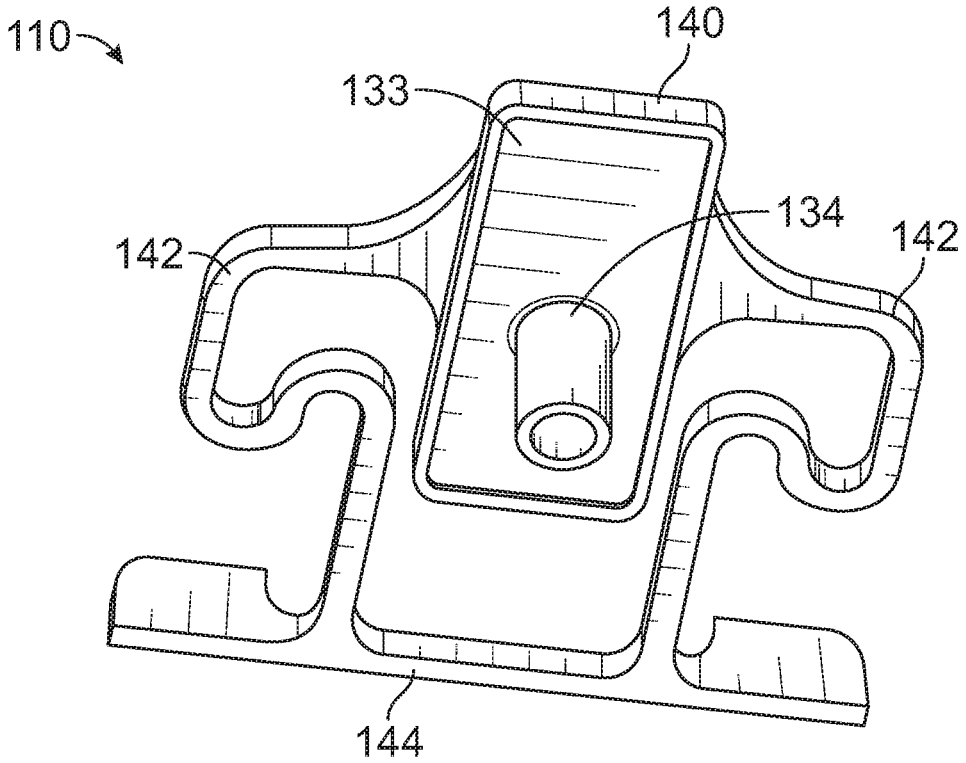
FIG. 4B is a perspective view from below the actuator of FIG. 4A showing the distal projection extending from the distal surface of the body portion.
Figure 5:
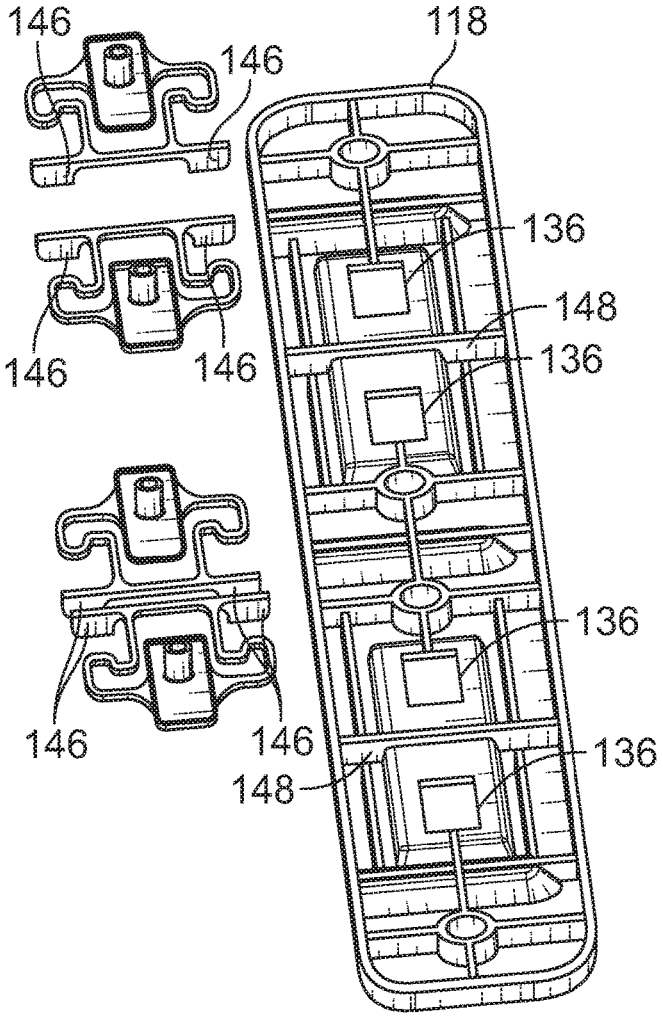
FIG. 5 is a perspective view of a bottom surface of the upper portion of the housing showing a plurality of actuators configured to be positioned therein.
Figure 6:
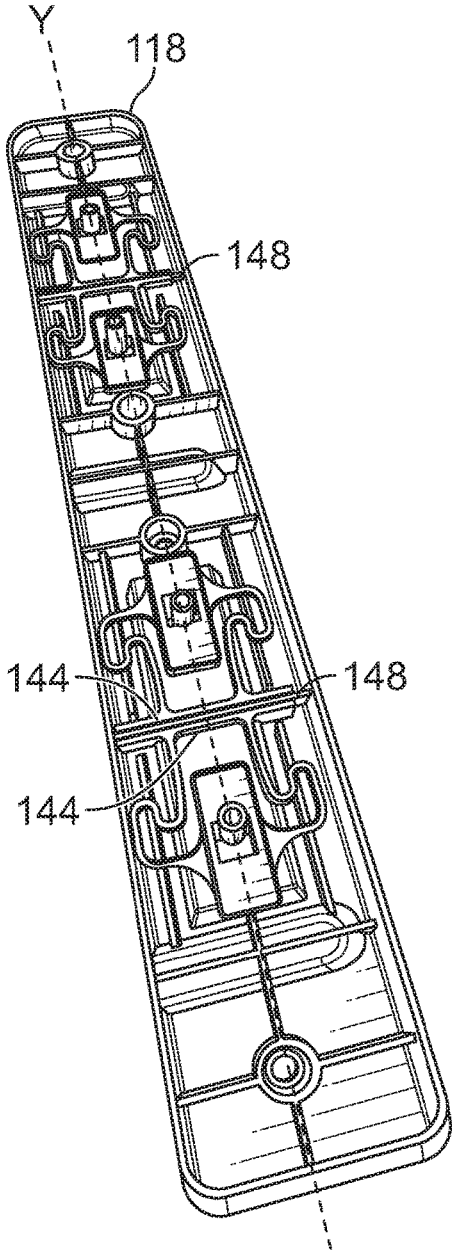
FIG. 6 is a perspective view similar to FIG. 5, showing the actuators placed in the upper portion of the housing such that the foot portion of each actuator is abutting an internal strut thereof.

Referring now to FIGS. 4A and 4B, each of the one or more actuators 110 may include a body portion 140, one or more arm portions 142, a foot portion 144, a tab, proximal surface or projection 138, and a distal projection 134. As illustrated, the proximal projection 138 is formed as a tab or flange extending from the remainder of the actuator 110, which permits easy, manual manipulation by the user. In one illustrative configuration, the proximal projection 138 has a contoured stair-stepped configured such that a user may engage the proximal projection 138 with his or her finger to move the actuator 110. In some forms, the proximal projection 138 may include some form of textured surface (e.g., one or more bumps, grooves, etc.) for improved engagement with a user's finger. In other forms, the proximal projection 138 may alternatively be a textured surface on the body portion 140 of the actuator 110 and may not extend upward from the proximal surface of the body portion 140.

As shown in FIG. 4A, a distal projection 134 extends from the body 140 generally opposite of the proximal projection 138. The distal projection 134 that is configured to be at least partially engaged with a guide aperture 126 of either the first or second panels 102, 106 is shown in a substantially cylindrical configuration extending from a distal surface 133 of the body portion 140. In other embodiments, the distal projection 134 may be of any other suitable shape for engagement with the guide aperture 126 according to the expansion operation described below.

The foot portion 144 of the actuator 110 may include one or more abutment surfaces 146 for abutting an internal strut 148 (shown in FIG. 6) of the housing 116 once the device 100 is assembled. These surfaces 146 are illustrated as paddle-shaped feet, but may be of other suitable configurations that are configured to abut the internal struts 148 or other internal structure of the housing 116. In operation, a user may move the body portion 140 via the proximal projection 138 toward the foot portion 144, which is abutting the internal strut 148, such that the arm portions 142 are flexed and/or otherwise compressed and loaded.

The arm portions 142 may be formed of a resilient material such as a resiliently deformable plastic, polymer, or rubber that is configured to return to an initial configuration upon compression or deformation thereof. As illustrated, in one exemplary configuration, the arm portions 142 extend at least partially between the body portion 140 and the foot portion 144 of the actuator 110 and include a generally S-shaped, curved portion. In such an embodiment, the S-shaped portion may be included to facilitate loading of the arm portion 142 to return the actuator 110 to an initial configuration upon compression thereof. In other forms, the arm portions 142 may include, for example, a Z-shaped portion, a zig-zag portion, or other shapes that would permit the arm portions 142 to bias the body portion 140 back to its initial configuration.

In operation, a user may engage and move the proximal projection 138 in an axial direction along the longitudinal axis Y (FIG. 1) causing corresponding movement of the body portion 140 and the distal projection 134 thereof. The abutment between the foot portion 144 and the internal strut 148 of the housing 116 is configured to cause the resilient arm portions 142 to flex and compress in the axial direction (e.g., via the S-shaped portion) as the body portion 140 is moved. Once the user disengages the actuator 110, the loaded arm portions 142 are configured to bias the body portion 140 and projections thereof back into its initial configuration. Example abutment between the foot portion 144 and abutment surfaces 146 of each actuator 110 and the internal strut 148 of the upper portion 118 of the housing 116 can be seen in FIGS. 5 and 6.

Although the actuator 110 shown is of a monolithic construction, in other forms the actuator 110 may be formed of separate components. For example, the arm portions 142 of the actuator 110 are shown integral with the body portion 140 but may alternatively comprise a separate component attached to the body portion 140. In still other forms, the actuator 110 may not include integral arm portions 142 and alternatively a resilient member such as a spring may be positioned between the body portion 140 and either the foot portion 144, the internal strut 148 or another surface of the housing 116.

Figure 7B:
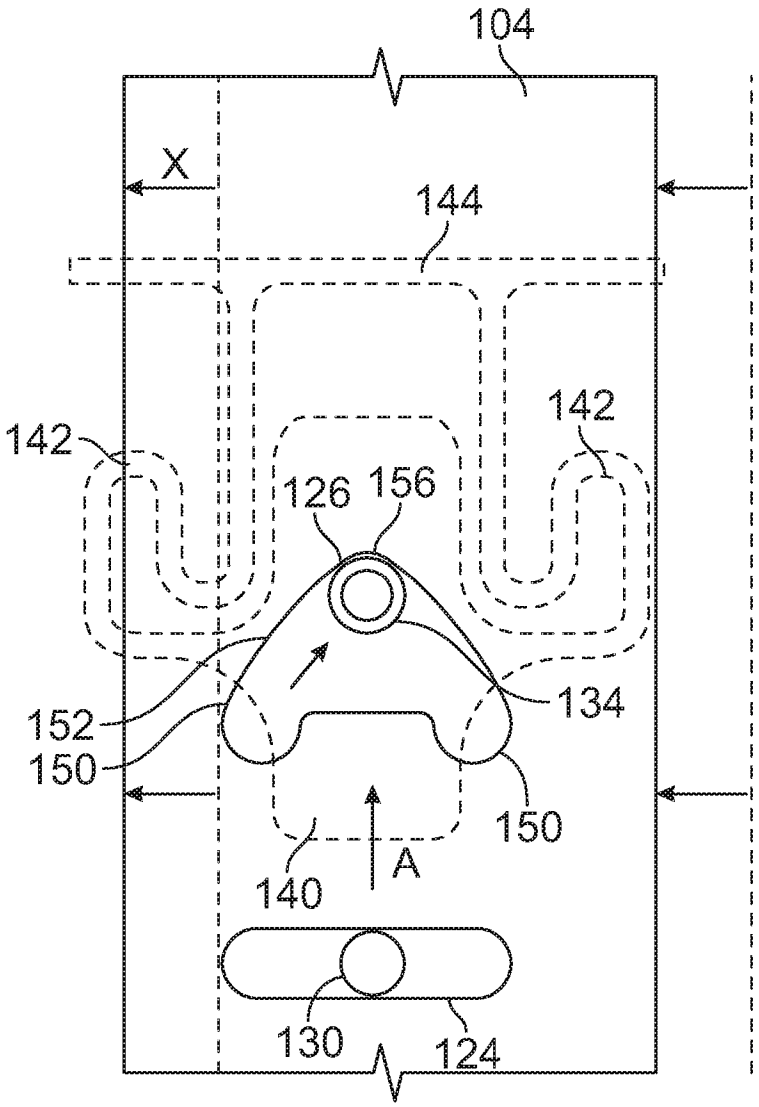
FIG. 7B is a plan view similar to FIG. 7A showing movement of the actuator in an axial direction to cause engagement between the distal projection thereof with an angled guide surface of the guide aperture to move the first panel relative to the second panel into an unlocked configuration.
Figure 7A:
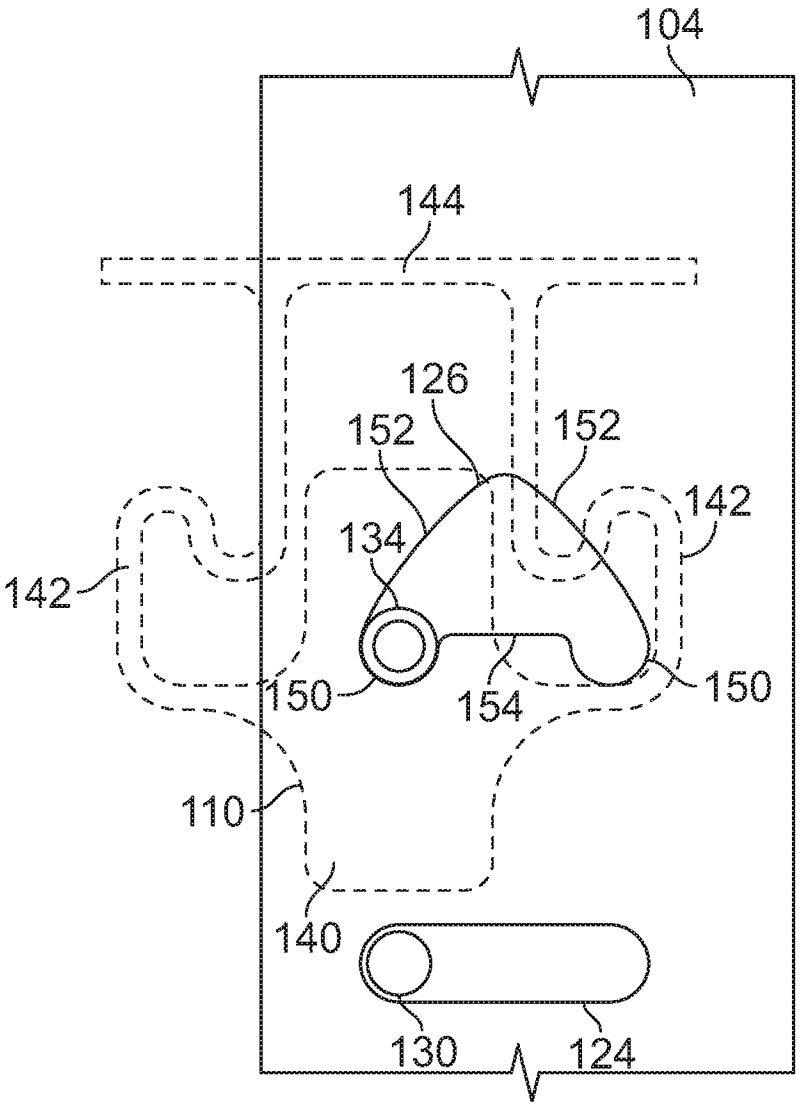
FIG. 7A is a plan view showing an initial position of the distal projection of the actuator engaged in a first leg portion of a heart-shaped guide aperture of the first panel spine portion such that the mechanism is in a locked configuration.

An example operation of one or the one or more actuators 110 to adjust the width of the spine 112 is illustrated sequentially in FIGS. 7A through 7D. It should be understood that the operation is reversible in a similar manner such that a like operation could be used to permit both expansion of the spine 112, and retraction of the spine 112 to the initial width. Referring to FIG. 7A, a cropped view from below the first panel spine portion 104 is shown illustrating the distal projection 134 of the actuator 110 engaged in one of the guide apertures 126. Specifically, the guide aperture 126 may include one or more leg portions 150, an angled or curved guide surface 152, and a flat or linear surface 154. As illustrated, the guide aperture 126 is substantially heart-shaped, but may be formed in other configurations as described below. In the initial configuration shown in FIG. 7A, the distal projection 134 is biased and seated at least partially in one of the leg portions 150 of the guide aperture 126. As shown, the leg portion 150 may be sized and shaped to correspond with the shape of the distal projection 134 (e.g., shaped to receive a cylindrical projection) such that the distal projection 134 is at least partially seated therein and inhibited from lateral movement, when disposed or seated therein. Engagement between the distal projection 134 and a selected leg portion 150 may be referred to as a locked configuration where the spine 112 of the device 100 is selectively retained at a desired width.

Once a user desires to adjust the width of the spine 112 of the expandable storage device 100, the user may apply a force to the actuator 110 (e.g., via the proximal projection 138 thereof) to move the body portion 140 and distal projection 134 in an axial direction A as shown in FIG. 7B. Upon application of force by the user, the foot portion 144 of the actuator 110 may abut the internal strut 148 of the housing 116 (not shown) and cause the arm portions 142 of the actuator 110 to flex such that the actuator 110 is in a compressed and loaded configuration. As the distal projection 134 is moved with the body portion 140, the distal projection 134 is unseated from the leg portion 150, entering an unlocked configuration, and urged towards the guide surface 152 of the guide aperture 126 to at least partially engage therewith and slide therealong. Because the actuator 110 is generally confined to a movement path along the longitudinal axis, the sliding engagement between the distal projection 134 and the guide surface 152 causes the first panel spine portion 104 to correspondingly move in the transverse, lateral direction X. The prior position of the first panel spine portion 104 is shown in dashed line for reference. This expansion of the spine 112 via movement of the first panel spine portion 104 may continue until the distal projection 134 reaches an apex 156 of the guide aperture 126. In this position, the resilient arm portions 142 of the actuator 110 are flexed and loaded.

Figure 7D:
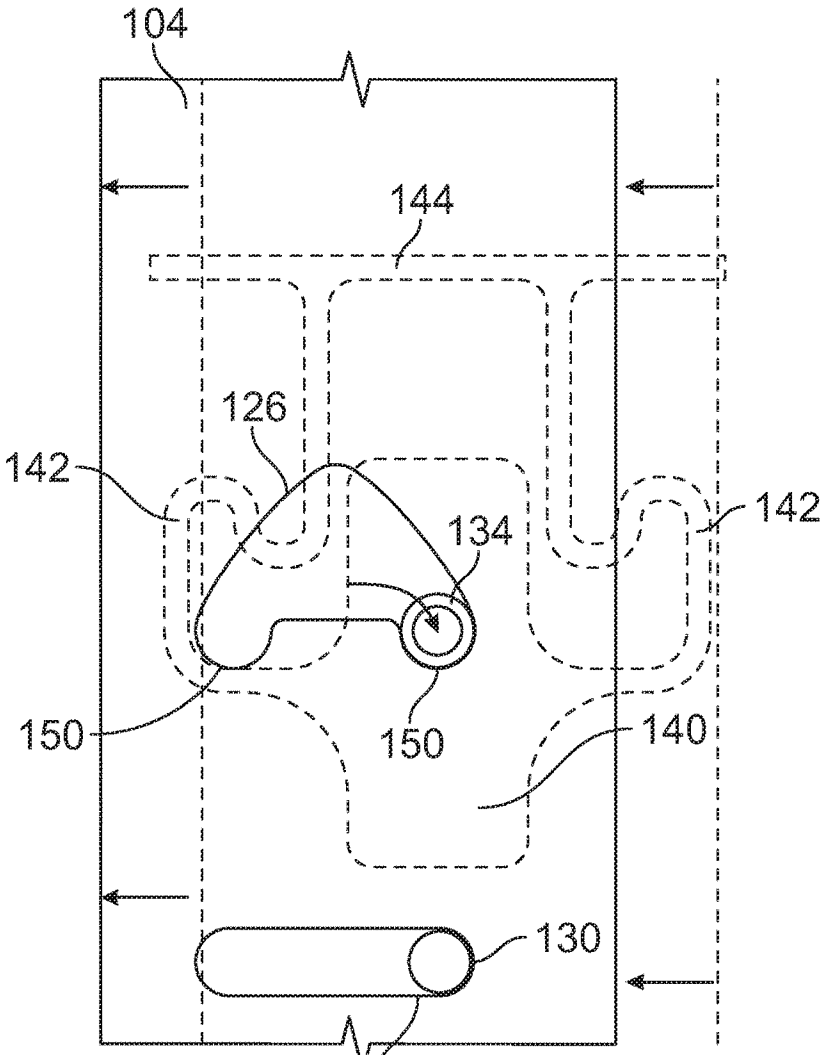
FIG. 7D is a plan view similar to FIG. 7A showing the distal projection of the actuator being slid along the flat surface and engaged in the other leg portion of the guide aperture.
Figure 7C:
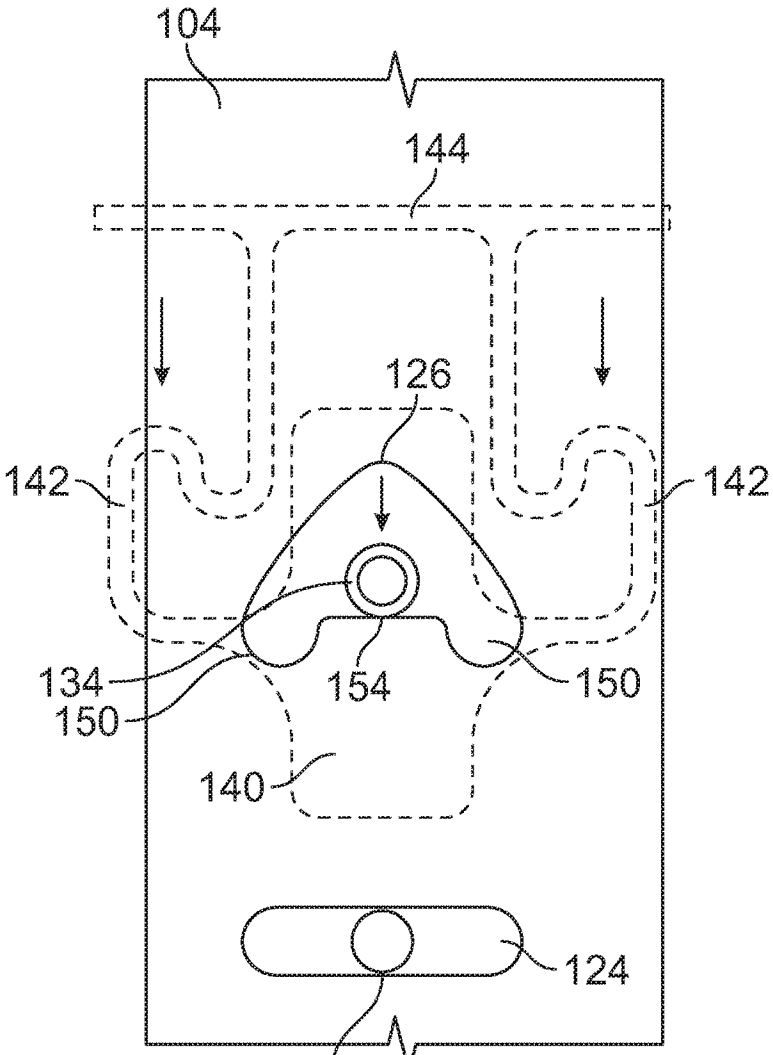
FIG. 7C is a plan view similar to FIG. 7A showing the distal projection engaged with a flat surface of the guide aperture in an unlocked configuration once a user has released the actuator and the resilient arm portions thereof have biased the distal projection in an opposing axial direction.

Once a user disengages or releases the actuator 110 (e.g., by ceasing to apply pressure to the proximal surface or projection 138 with his/her finger or other object), the flexed and loaded arm portions 142 of the actuator 110 cause the body portion 140 thereof to bias back in a direction opposite the axial direction A as shown in FIG. 7C. The distal projection 134 is shown being biased back into contact with the linear surface 154 of the guide aperture 126 such that the actuator 110 remains in an unlocked configuration. From this position, the user may move the first panel 102 including the first panel spine portion 104 in either lateral direction along the lateral axis X (referring to FIG. 7C, either to the "left" or "right") such that the distal projection 134 may slide along the linear surface 154 until it is biased and lockingly seated in one of the two leg portions 150. For example, as shown in FIG. 7D, the user has selected to adjust the width of the spine 112 by moving the first panel 102 in the lateral direction to the left such that the distal projection is biased into the other leg portion 150. Again, once seated, the biasing force applied by the resilient arm portions 142 may inhibit any lateral movement of the distal projection thus selectively retaining the spine 112 at the new adjusted width.

It should further be understood that the adjustment or expansion operation shown in FIGS. 7A-7D may likewise be used to return the width of the spine 112 to an initial configuration. For instance, the user may desire to return the expandable storage device 100 to the initial width (e.g., if inserts or loose-leaf papers are removed from the expandable storage device) at a later point in time. Once the distal projection 134 is seated in the other leg portion 150 as shown in FIG. 7D, the user may similarly apply force in an axial direction to the proximal projection 138 to cause sliding engagement between the distal projection 134 and the guide surface 152 to move the actuator 110 into the unlocked configuration. Thereafter, the user may similarly select which leg portion 150 that the distal projection 134 will engage in. Each of the one or more actuators 110 of the expandable storage device 100 may operate in a similar manner.

In some embodiments where there are multiple pairs of actuators 110 for adjusting the width of the spine (e.g., FIG. 1 including the outer pair and inner pair of actuators), the user may be required to perform the example expansion operation described in FIGS. 7A-7D on each actuator of the respective pair in order to adjust the width of the spine.

The partially overlapping relationship of the first panel spine portion 104 and the second panel spine portion 108 is shown more clearly in FIG. 8. Specifically, FIG. 8 illustrates a plan view from below the spine 112 with the base or lower portion 120 of the housing 116 partially in ghost to show the first panel spine portion 104 partially overlapping the second panel spine portion 108 and illustrating various slots 124 (with posts 130 extending therethrough), guide apertures 126, and relief apertures 128 thereof. Both the lateral axis X and the longitudinal axis Y are reproduced for reference. The relief apertures 128 of the first panel spine portion 104 generally overlap the guide apertures 126 of the second panel spine portion 108, and the guide apertures 126 of the first panel spine portion 104 generally overlap the relief apertures 128 of the second panel spine portion 108. As such, there is a common opening between each set of guide apertures 126 and relief apertures 128 such that the distal projection 134 of an actuator 110 may be advanced therethrough.

As illustrated, the distal projections 134 of each actuator extend through one respective guide aperture 126 and one respective relief aperture 128. Via this alternating relationship between the guide and relief apertures 126, 128 of the first and second panel spine portions 104, 108, multiple discrete expansion operations are possible. For instance, this relationship permits either: (1) the first panel spine portion to move relative to the second panel spine portion to adjust a width of the spine by a first amount, and/or (2) the second panel spine portion to move relative to the first panel spine portion to adjust the width of the spine by a second amount. The first amount of adjustment may be equivalent to the second amount of adjustment, or it may be smaller or larger.

In the example operation (1), actuation by the user of the two inner actuators (e.g., in the manner described in FIGS. 7A through 7D) will cause the distal projection 134 of each actuator 110 to unlock and slide along the respective guide surface 152 of each guide aperture 126 to move the first panel spine portion 104 relative to the second panel spine portion 108 to the position shown in FIG. 7B, at which point the user can pull the first panel 102 in the lateral direction such that the distal projections 134 of the inner actuators 110 are lockingly seated in selected leg portions 150. This example operation (1) is shown in further detail in FIG. 10. Further, as a result of the relief aperture 128 on the second panel spine portion 108, the expansion of the spine 112 via the operation (1) does not interfere with or inhibit expansion or adjustment of the second panel spine portion 108. This in turn permits selective expansion of either, or both, or the first and second panel spine portions 104, 108.

Figure 9:
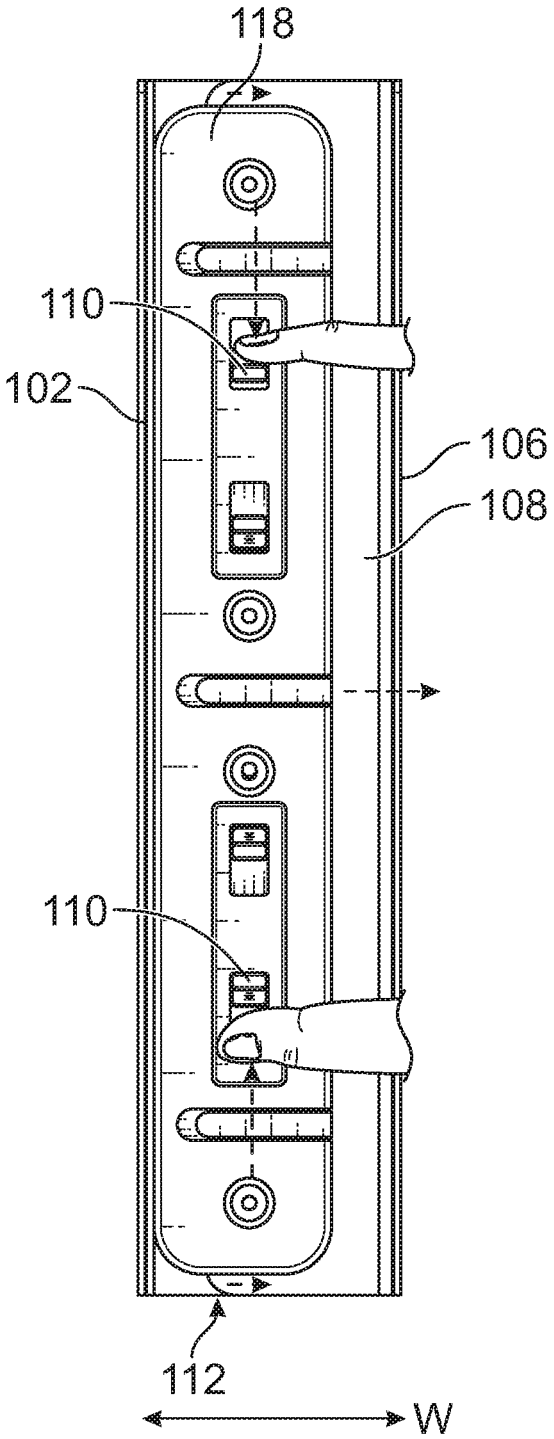
FIG. 9 is a plan view from above the spine of an example expandable storage device showing an outer pair of actuators being moved in opposing axial directions to move the second panel relative to the first panel to expand the width of the spine.
Figure 10:
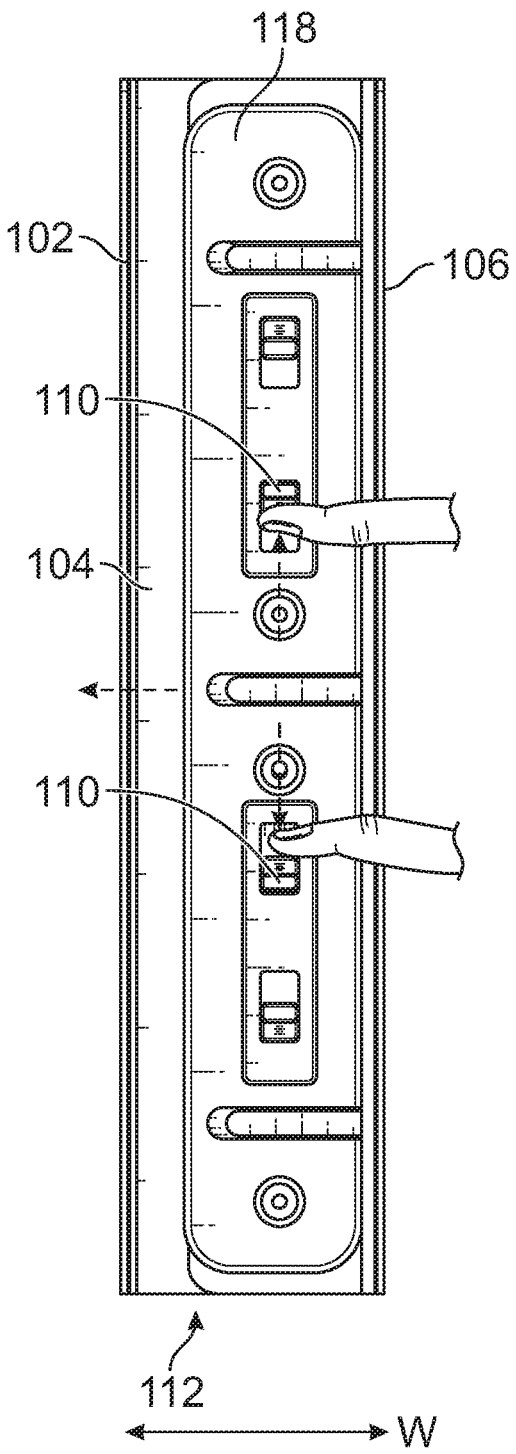
FIG. 10 is a plan view similar to FIG. 9 showing an inner pair of actuators being moved in opposing axial directions to move the first panel relative to the second panel to expand the width of the spine.
Figure 11:
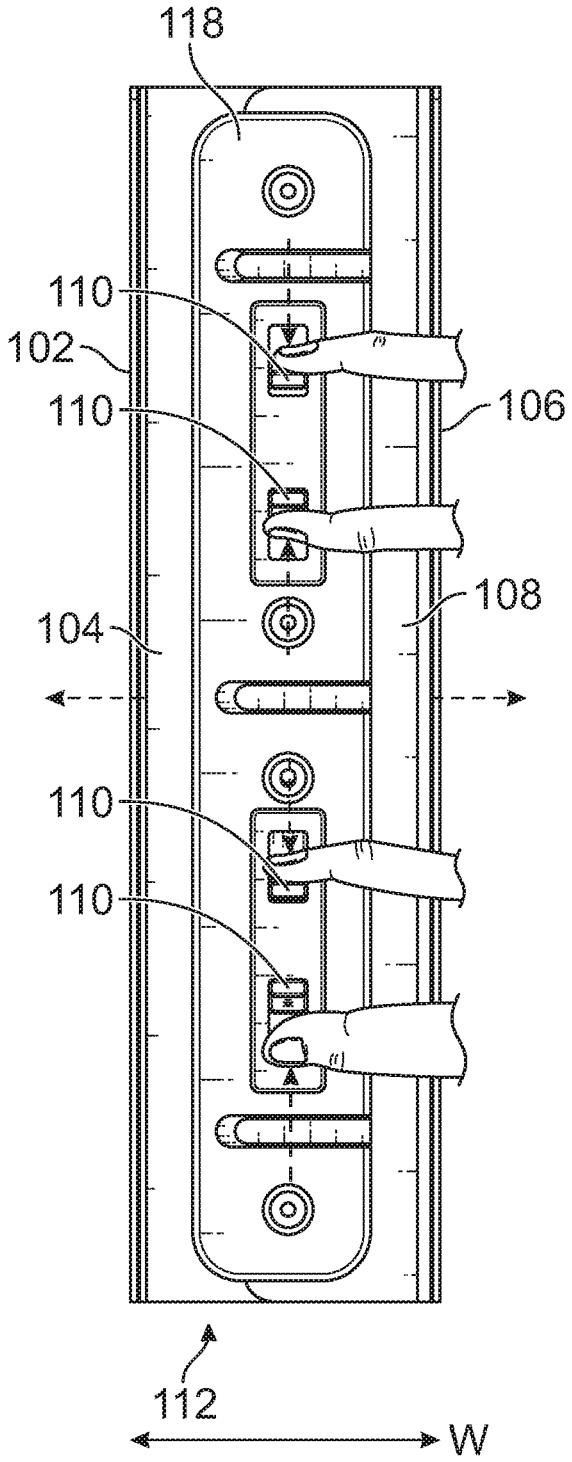
FIG. 11 is a plan view similar to FIG. 9 showing both the inner and outer pairs of actuators being moved by a user to cause both the first and second panels to move relative to one another to expand the width of the spine.

Referring to FIGS. 9-11, various selective adjustment operations of the spine 112 of the expandable storage device 100 are illustrated. Specifically, through use of the alternating guide apertures 126 and relief apertures 128, the first and second spine panel portions 104, 108 may be moved relative to one another into a variety of different configurations to form a spine 112 having different, desired widths. For example, in FIG. 9, the spine 112 is shown moving from an initial, first width (before any expansion or adjustment has occurred) to a second width larger than the first width. The outer pair of actuators 110 are shown being moved in opposing axial directions by a user which causes the distal projections 134 thereof to engage with and slide along respective guide surfaces 152 of the guide apertures 126 of the second panel spine portion 108 to enter an unlocked configuration as described with respect to FIGS. 7A-7D. Then, the user may slide the second panel spine portion 108 in the direction indicated to lockingly seat the distal projections 134 in the other leg portions 150 of the guide apertures 126 to selectively retain the spine 112 at the new, expanded width.

It should further be understood that the spine 112 may be retracted from the second width back to the initial width by moving the actuators 110 in a similar manner. For example, movement of the outer pair of actuators 110 after the spine 112 has been expanded to the second width is configured to cause that the distal projections 134 thereof to slide along respective guide surfaces 152 of the guide apertures 126 to again enter the unlocked configuration. The user may then slide the second panel spine portion 108 opposite the direction shown in FIG. 9 (e.g., by pushing the second panel 106 or associated spine portion 108) to lockingly seat the distal projections 134 in the original leg portions 150 of the guide apertures 126 to selectively retract and retain the spine 112 at the initial width. As described hereinafter, each of the adjustment operations shown in FIGS. 9-11 may be reversible in a similar manner to permit the spine 112 to be selectively retained at various retracted or expanded configurations.

As shown in FIG. 10, a similar operation as already described above is illustrated showing the spine 112 being expanded via movement of the first panel spine portion 104 using the inner pair of actuators 110. Specifically, FIG. 10 shows the spine 112 moving from an initial, first width (before any expansion or adjustment has occurred) to a third width larger than the first width. In some forms, the third width (FIG. 10) may be the same as the second width (FIG. 9), or in other forms may be different.

In some forms, both the inner pair of actuators 110 and the outer pair of actuators 110 may be actuated to permit both expansion of the spine 112 via the first panel spine portion 104 and expansion of the spine 112 via the second panel spine portion 108 to a new width larger than either expansion alone would permit. For example, as shown in FIG. 11, a user may move both pairs of actuators 110 (e.g., by pinching the actuators towards one another with the user's fingers) to cause the expandable storage device 100 to enter an unlocked configuration as described above. The user may then move both the first and second panels 102, 106 apart from one another in the directions illustrated to cause the distal projections 134 of each actuator 110 to bias and lockingly engage into other leg portions of each respective guide aperture 126 such that the spine 112 has been expanded to a fourth width larger than the first, initial width thereof. In some forms, the fourth width may be substantially equivalent to the increased width of the spine 112 resulting from the expansions shown in FIGS. 9 and 10, or in other forms may be different. These adjustment operations may be completed at substantially the same time (e.g., as shown in FIG. 11) or may be performed sequentially over a period of time as additional articles are added to the expandable storage device 100. For example, the user may desire some additional space initially and perform the expansion operation shown in FIG. 9 to expand the spine 112 to the second width, and may desire further space at a later time and perform the expansion operation shown in FIG. 10.

So configured, the expandable storage device 100 may be expanded and selectively retained at various different desired widths depending on the thickness of the articles to be contained within. Likewise, the expandable storage device 100 may be returned to and retained at an initial, unexpanded configuration using similar operations when a user may desire a storage device having a narrower width.

Although described as pairs of actuators in the context of FIGS. 9-11, it should be understood that an odd number of actuator(s) may be employed. For example, a single actuator 110 may be provided to permit an adjustment operation as provided herein. In some forms, the expandable storage device 100 may only include a single actuator 110, or may include a first actuator for a first expansion of the spine 112 and a second actuator for a second expansion of the spine 112. So configured, the expandable storage device 100 may be configured to adjust the spine 112 of the device 110 to a variety of different widths by using different actuators combinations and configurations.

Figure 12:
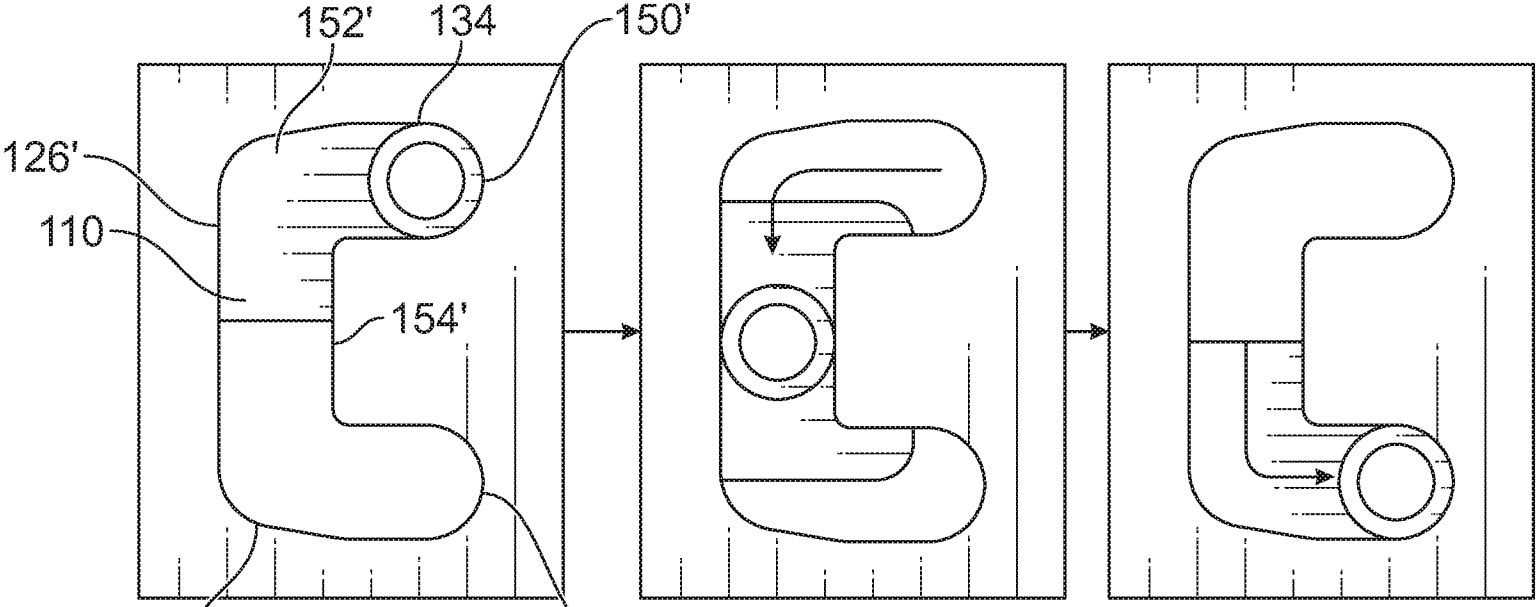
FIG. 12 is a plan view showing three sequential configurations of an alternative guide aperture having a distal projection of an actuator engaged therein, the guide aperture having a first leg portion, a second leg portion, and guide surfaces.

In alternative forms, the guide apertures 126 of the first and second panel spine portions 104, 108 may be formed in other configurations. For example, in FIG. 12, an alternative guide aperture 126' is illustrated that is substantially U-shaped or C-shaped, and includes one or more leg portions 150', one or more angled guide surfaces 152', and one or more linear or flat portions 154'. Specifically, FIG. 12 shows exemplary sequential configurations of the guide aperture 126' and the distal projection 134 during an adjustment operation that is similar to the operation described in FIGS. 7A-7D. As shown in the leftmost image, the distal projection 134 of an actuator 110 is engaged with and at least partially seated in a leg portion 150' of the guide aperture 126'. Upon movement of the actuator 110 in an axial direction, the distal projection 134 is configured to engage with and slide along the guide surface 152' to facilitate a transition to an unlocked configuration shown in the center image. Then, the user may move one or more of the panels such that the distal projection 134 slides along the flat surface 154' and is biased back into and lockingly engaged with the other leg portion 150'. In a similar manner, lateral movement of the distal projection 134 is inhibited once the distal projection 134 is moved to the locked configuration such that the spine 112 may be selectively retained at the adjusted width. It should be understood that guide apertures having various angled, curved, or linear surfaces may be used to engage with and guide the distal projection within or along surfaces of the aperture. For example, in some forms the guide aperture may be substantially S-shaped, W-shaped, or may be one of any other suitable configuration to facilitate guiding of the distal projection therein and permit the expansion operations provided herein. In addition, although described as a linear or flat surface 154, the surface 154 may in some embodiments be of an angled or curved configuration.

Although the example guide apertures 126 and 126' are shown having two leg portions, such guide apertures may include three or more leg portions to further increase the adjustment widths at which the spine 112 may be retained. For example, in an embodiment of the guide aperture having three leg portions, the distal projection 134 may be moved to an unlocked configuration and moved to any selected leg portion corresponding with a different expansion width of the spine 112. In still other forms, the guide aperture may not include leg portions and may include another structure to lockingly secure the distal projections at a selected position. In still further forms of an expandable storage device having multiple guide apertures and multiple actuators, each of the guide apertures need not be of the same configuration. For example, each of the multiple guide apertures may formed in different shapes or may include differing guide surfaces from one another.

Figure 14:
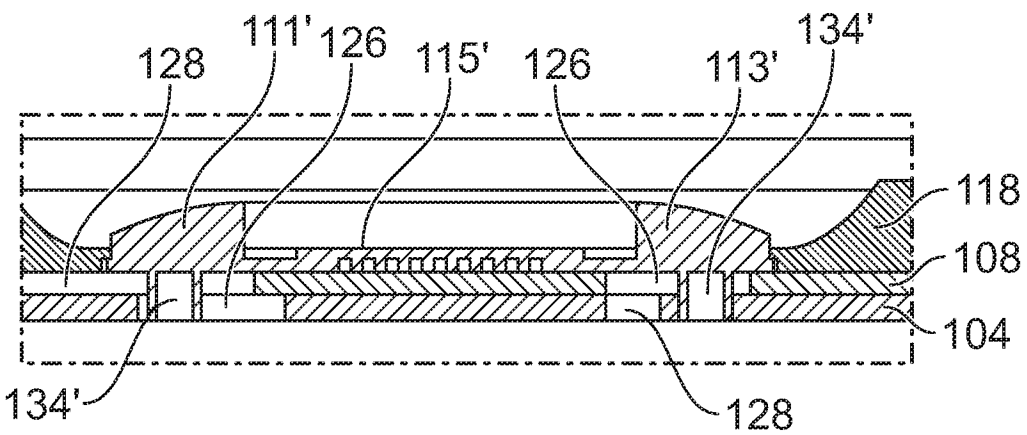
FIG. 14 is a cross sectional view of the alternative actuator of FIG. 13 showing a distal projection of each actuator button engaged in apertures of the first and second panel spine portions.
Figure 13:
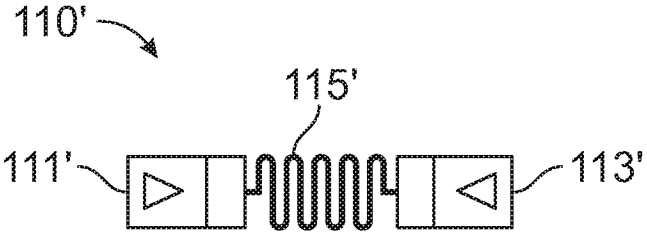
FIG. 13 is a top plan view of an alternative actuator for use in an expandable storage device having two actuator buttons with a resilient member extending therebetween.

Additionally, various alternative actuators may be used in connection with the expandable storage devices 100 described herein. As illustrated in FIGS. 13 and 14, an alternative actuator 110' includes two actuator buttons 111', 113' having a resilient member 115' extending therebetween to bias the actuator buttons 111', 113' into an initial configuration. The resilient member 115' may be formed of, for example, a metal spring or other resilient material such as a resilient plastic. In the illustrated form, the resilient member 115' is in the form of a plastic spring having various S-shaped curves along a length thereof. So configured, movement of either actuator button 111', 113' towards the other actuator button will cause compression and loading of the resilient member 115' such that subsequent release of either button 111', 113' will cause the resilient member 115' to bias the actuator buttons 111', 113' back into the initial configuration. As such, the actuator buttons 111', 113' are coupled to one another and biased together such that the actuator 110' does not require a similar foot portion for abutting an internal surface of the housing 116.

As illustrated, the actuator buttons 111', 113' may include some form of instruction, symbol, or notation (e.g., the arrow illustrated thereon, a notice to "push here," etc.) to remind or instruct the user regarding the direction in which the respective button must be moved to permit adjustment of the width of the spine in the manner described herein. Such instructions, symbols, or notations may likewise be included on the one or more actuators 110, the housing 116, or the panels 102, 106 themselves in the form of a sticker or other marking.

A cross-sectional view of the actuator 110' is shown in FIG. 14, illustrating a distal projection 134' of the actuator 110' advanced through both the first panel spine portion 104 and the second panel spine portion 108. Specifically, the distal projection 134' of the leftmost actuator button 111' may be advanced through a guide aperture 126 of the first panel spine portion 104 and a relief aperture 128 of the second panel spine portion 108, and the distal projection 134' of the rightmost actuator button 113' may be advanced through a relief aperture 128 of the first panel spine portion 104 and a guide aperture 126 of the second panel spine portion 108. So configured, actuation of the leftmost actuator button 111' may be configured to cause expansion of the spine 112 via the first panel spine portion 104 and actuation of the rightmost actuator button 113' may be configured to cause expansion of spine 112 via the second panel spine portion 108.

Figure 15:
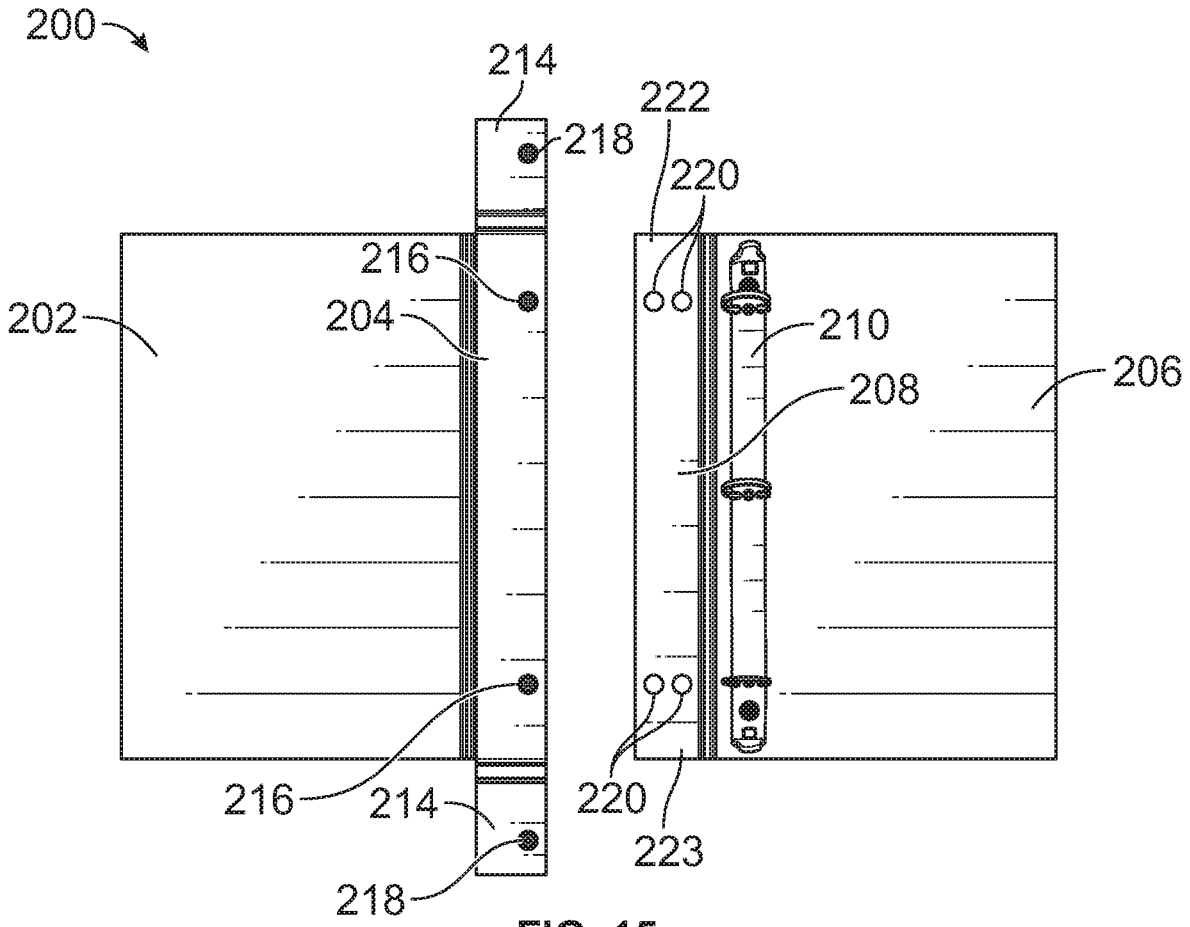
FIG. 15 is a top plan view of an alternative expandable storage device showing a first panel having a first panel spine portion with wing panels extending therefrom, and a second panel having a second panel spine portion including a plurality of apertures.
Figure 16:
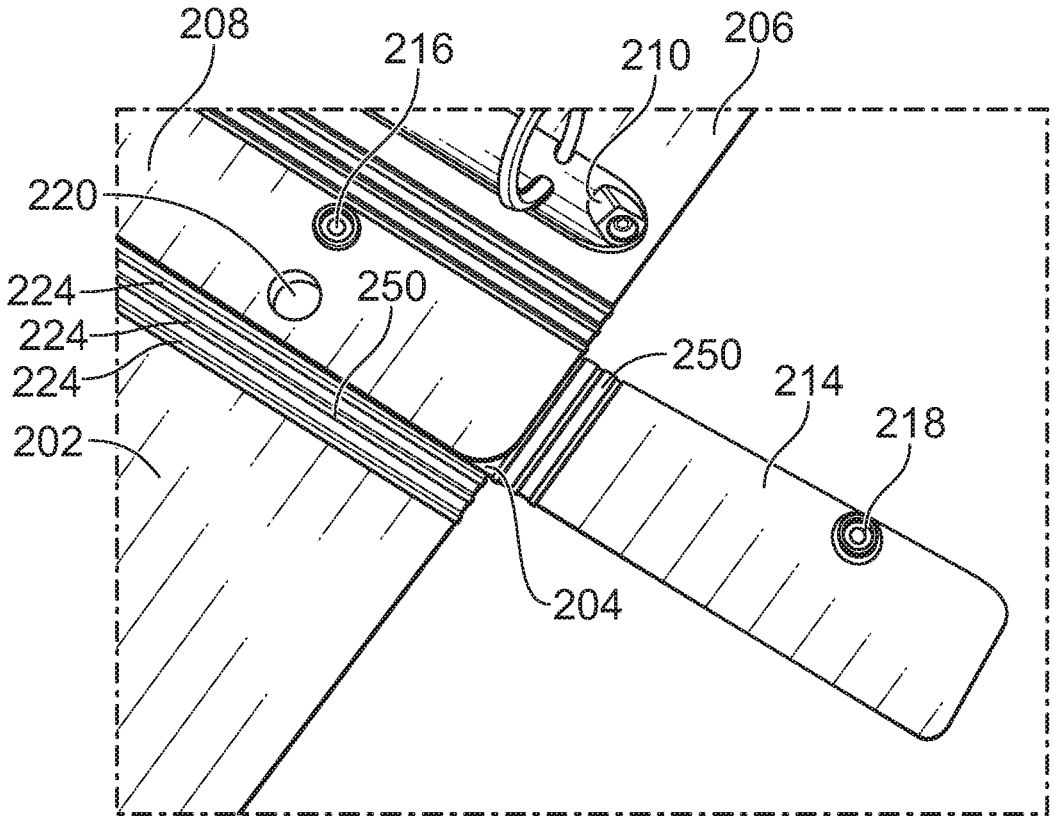
FIG. 16 is a perspective view of a lower portion of the expandable storage device of FIG. 15 showing a first fastening member on the first panel spine portion extending through a selected aperture of the second panel spine portion and a second fastening member on the wing panel configured to be releasably coupled thereto.
Figure 17:
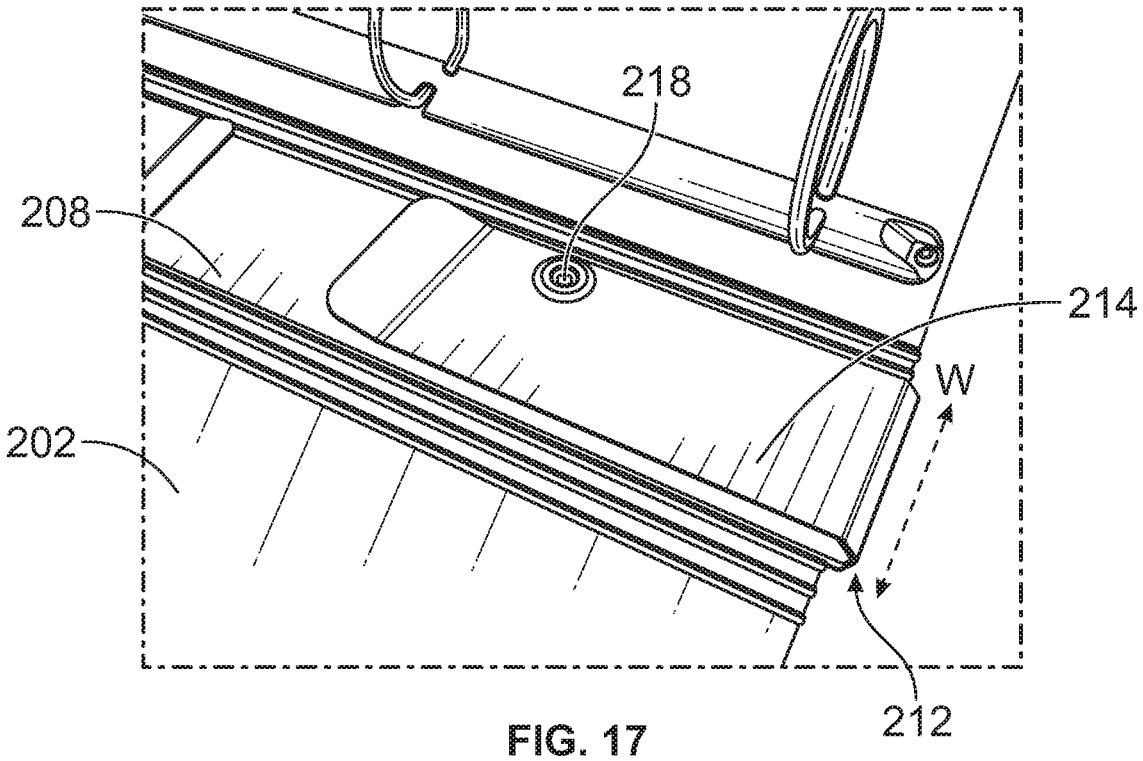
FIG. 17 is a perspective view similar to FIG. 16 showing the second fastening member of the wing panel releasably coupled to the first fastening member of the first panel spine portion such that a spine of the device is selectively secured at a desired width.
Figure 18:
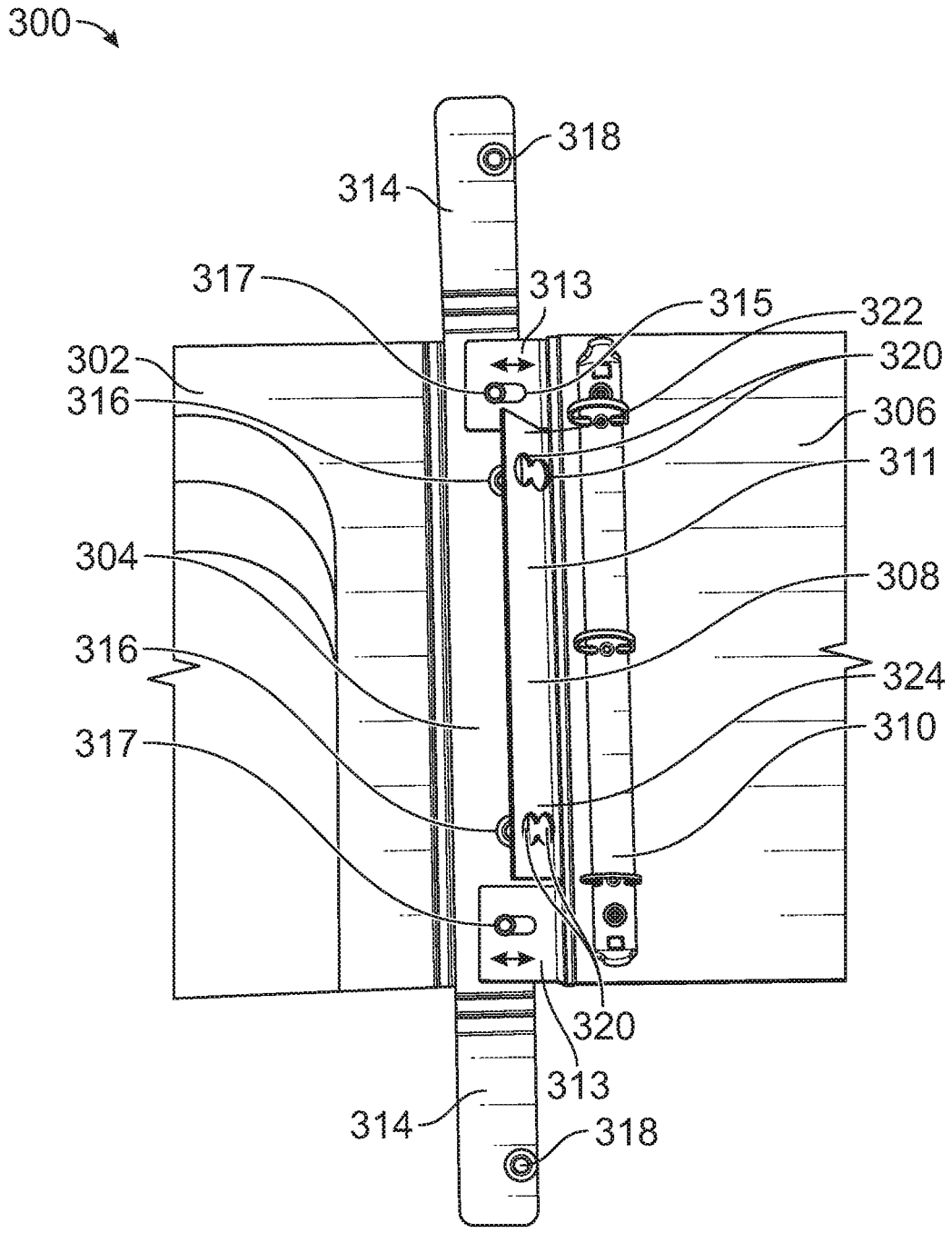
FIG. 18 is a perspective view of yet another alternative expandable storage device similar to FIG. 15 showing the second panel spine portion slidably coupled to the first panel spine portion via securing flaps thereof and further having an attachment flap.
Figure 20:
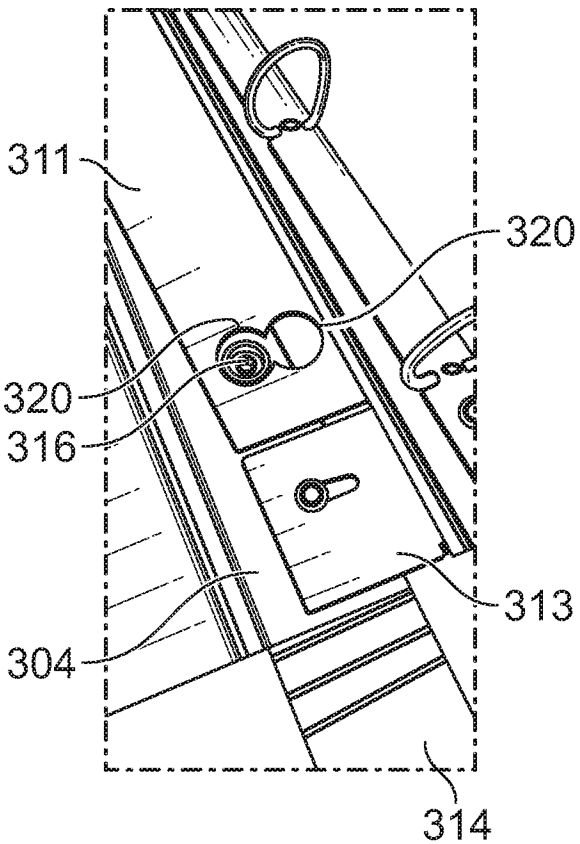
FIG. 20 is a perspective view similar to FIG. 19 showing the selected aperture of the attachment flap positioned over the first fastening member.
Figure 19:
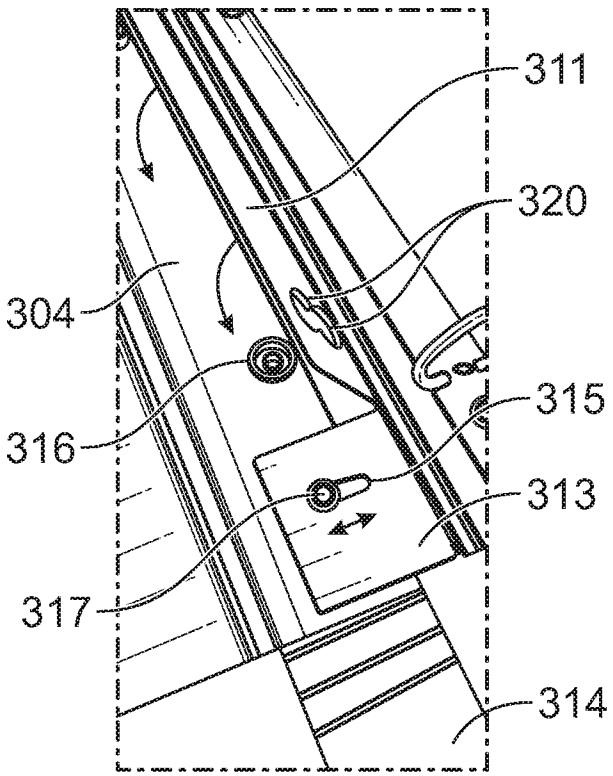
FIG. 19 is a perspective view of a lower portion of the expandable storage device of FIG. 18 showing a rivet engaged in a slot of the securing flap to slidably move the second panel such that a selected aperture of the attachment flap corresponding with a selected width of the spine is aligned with a first fastening member of the first panel spine portion.

Yet another expandable storage device 200 is illustrated in FIGS. 15-17 that includes a first panel 202 having a first panel spine portion 204 and a second panel 206 having a second panel spine portion 208 and a three-ring binding 210 attached thereto. In some forms, the first and second panels 202, 206 may be formed of a plastic or polymer material. Once assembled (shown in FIGS. 16 and 17), the first panel spine portion 204 and the second panel spine portion 208 form a spine 212 having a width W (FIG. 17). The first panel 202 further includes one or more wing panels 214 extending from the first panel spine portion 204. In other forms, the wing panels 214 may extend from other portions of the first panel 202. The first panel spine portion 204 may include one or more first fastening members 216 and each of the wing panels 214 may include one or more second fastening members 218 configured to mate and engage with the first fastening members 216. For example, the first fastening member 216 may be formed as a male snap and the second fastening member 218 may be formed as a female snap configured to snap over, and be resiliently engaged on, the first fastening member 216. In other forms, the first and second fastening members 216, 218 may include hook-and-loop fasteners such as Velcro®, clips, magnets, clasps, structures having inter-engaging geometries, or the like.

The second panel spine portion 208 includes one or more apertures 220 that are configured to be aligned with, and advanced over the first fastening member 216 of the first panel spine portion 204 (shown in FIG. 16). The wing panels 214 may be thereafter be flexed and/or folded to partially overlap the second panel spine portion 208 and the second fastening members 218 may be coupled to the respective first fastening members 216 (shown in FIGS. 16 and 17) to selectively retain the spine 212 at a desired width. The apertures 220 may be formed in the second panel spine portion 208 as die-cut holes.

The spacing of the apertures 220 in the lateral direction X may correspond with different desired widths of the spine 212. For example, as illustrated, the second panel spine portion 208 includes two apertures 220 on an upper portion 222 thereof aligned with two apertures 220 on a lower portion 223 thereof. The leftmost apertures of the apertures 220 are configured to form a spine 212 having a larger width once coupled to the first panel 202 via the first and second fastening members 216, 218 and the rightmost apertures of the apertures 220 are configured to form a spine 212 having a smaller width once coupled as described. In other forms, the second panel spine portion 208 may include any number of apertures 220 corresponding to different spine widths such that the user is permitted to adjust the spine 212 to accommodate a variety of different articles or sheets stored in the device 200. If a different width of the spine 212 is desired, the user may decouple the first and second fastening members 216, 218, select a different aperture 220 of the second panel spine portion 208 to align therewith, and recouple first and second fastening member 216, 218 accordingly.

The expandable storage device 200 may further includes various flex areas 250 (FIG. 16) between, for example, the one or more wing panels 214 and the first panel spine portion 204 such that the wing panels 214 are permitted to flex and bend thereover. In addition, a flex area may be formed along a line between the first panel 202 and the first panel spine portion 204, and the second panel 206 and the second panel spine portion 208, to permit the device 200 to flex and move between an open configuration and a closed configuration. For example, the flex area 250 may include a plurality of transverse crease lines 224 or areas of weakness formed therein, or alternatively, may be formed of a different material such as a thinner plastic sheet or fabric. Such crease lines may be formed at least in part by perforating or slitting the panels.

Figure 21:
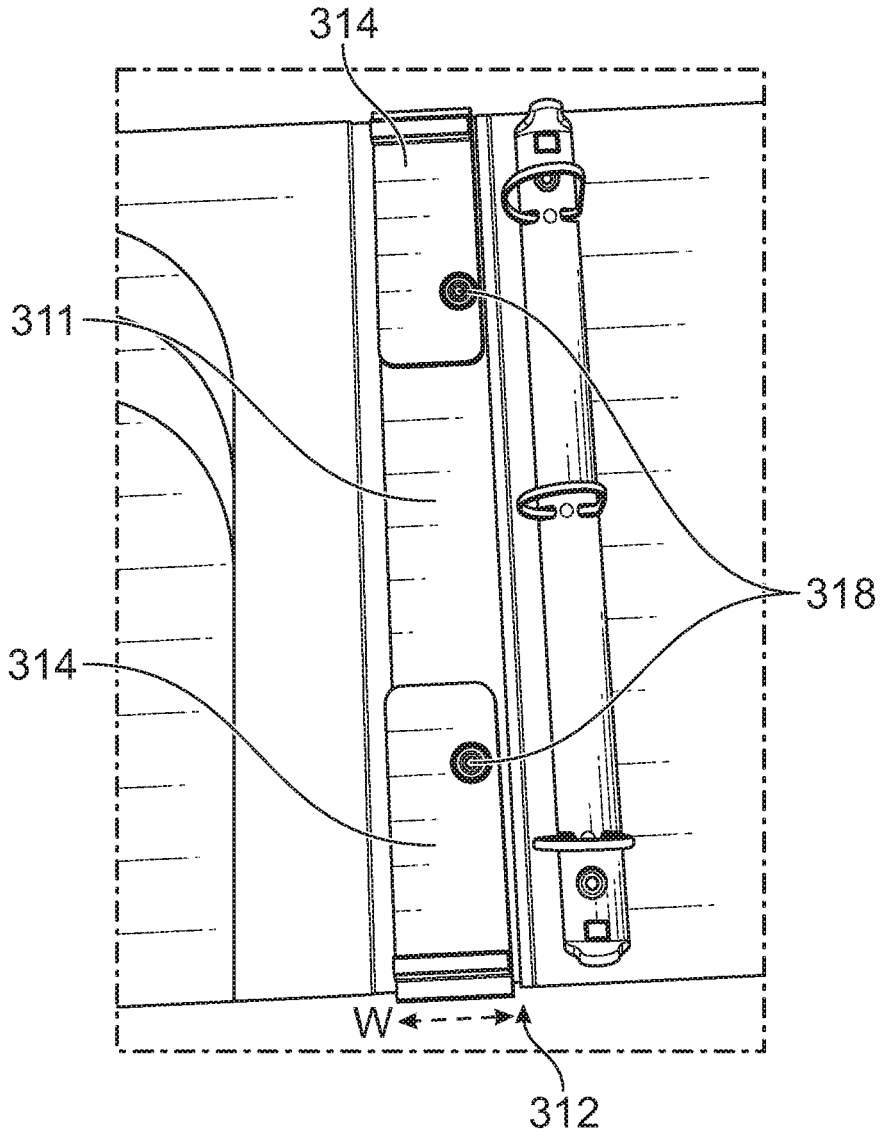
FIG. 21 is a perspective view of the expandable storage device of FIG. 18 showing the wing panels coupled to the first fastening members such that the spine is selectively secured at a desired width.

In still another form, another example embodiment of an expandable storage device 300 is shown in FIGS. 18-21. The expandable storage device 300 functions similarly to the expandable storage device 200. The expandable storage device 300 includes a first panel 302 having a first panel spine portion 304 and a second panel 306 having a second panel spine portion 308. The first panel spine portion 304 and the second panel spine portion 308 form a spine 312 having a width W (FIG. 21). The device 300 may include a three-ring binding 310 or other binding mechanism attached thereto. As shown, the second panel spine portion 308 includes an attachment flap 311 pivotably coupled thereto having a plurality of apertures 320 extending therethrough, and a pair of securing flaps 313 having slots 315 that are slidably coupled to the first panel spine portion 304.

The first panel 302 further includes one or more wing panels 314 extending from the first panel spine portion 304. The first panel spine portion 304 includes one or more first fastening members 316 and each of the wing panels 314 includes one or more second fastening members 318 configured to mate and engage with the first fastening members 316. For example, the first fastening member 316 may be formed as a male snap and the second fastening member 318 may be formed as a female snap configured to snap over, and be resiliently engaged on, the first fastening member 316. In other forms, the first and second fastening members 316, 318 may include hook-and-loop fasteners such as Velcro®, clips, magnets, clasps, structures having inter-engaging geometries, or the like.

As noted above, the securing flaps 313 of the second panel spine portion 308 may be slidably coupled to the first panel spine portion 304 via the slots 315 to permit the second panel 306 to slide relative to the first panel 302. This may be achieved by using, for example, a rivet or attachment structure 317 that extends through the slot 315 of each securing flap 313 and permits the flap 313 to slide along the length of the slot 315 but inhibits detachment between the first and second panels 302, 306.

The attachment flap 311 of the second panel spine portion 308 may include one or more apertures 320 that are configured to be aligned with, and advanced over the first fastening members 316 of the first panel spine portion 304 (shown in FIGS. 19 and 20) such that the wing panels 314 may be folded over to partially overlap the second panel spine portion 308 and the second fastening members 318 may be coupled to the respective first fastening members 316 to selectively retain the spine 312 at a desired width (shown in FIG. 21). The spacing of the apertures 320 in the lateral direction X may correspond with different desired widths of the spine 312. For example, as illustrated, the attachment flap 311 includes two overlapping apertures 320 on an upper portion 322 thereof aligned with two overlapping apertures 320 on a lower portion 324 thereof. Although the apertures 320 are illustrated as partially overlapping (i.e., the overlapping apertures partially form a common opening in the attachment flap 311), each aperture may be configured to correspond with and be advanced over a first fastening member 316. Via the overlapping aperture 320 configuration, more apertures may fit and be included along the attachment flap 311 thereby permitting even more granular, variable adjustment of the spine 312.

The leftmost apertures of the apertures 320 are configured to facilitate formation of a spine 312 having a larger width once coupled to the first panel 302 via the first and second fastening members 316, 318 and the rightmost apertures of the apertures 320 are configured to facilitate formation of a spine 312 having a smaller width once coupled as described. In other forms, the attachment flap 311 may include any number of apertures 320 corresponding to different spine widths such that the user is permitted to adjust the spine 312 to accommodate a variety of different articles or sheets stored in the device 300. If a different width is desired, the user may decouple the first and second fastening members 316, 318, select a different aperture 320 of the attachment flap 311 corresponding with a desired width, slide the securing flaps 313 along the slots 315 to align the selected aperture 320 with the first fastening member 316, and recouple first and second fastening members 316, 318 accordingly.

Figure 22:
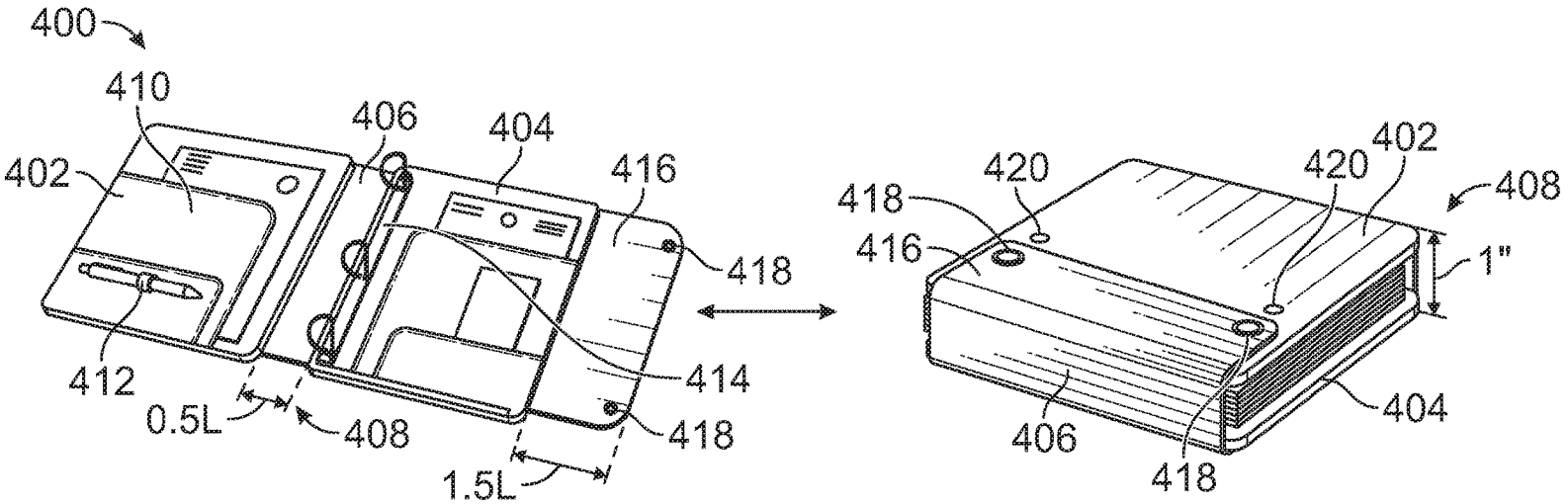
FIG. 22 is a perspective view of yet another example expandable storage device having a first panel and a second panel that is movable between an open configuration and a closed configuration, and showing a flexible spine member slidably engaged with second panel to permit expansion of the spine.
Figure 23:
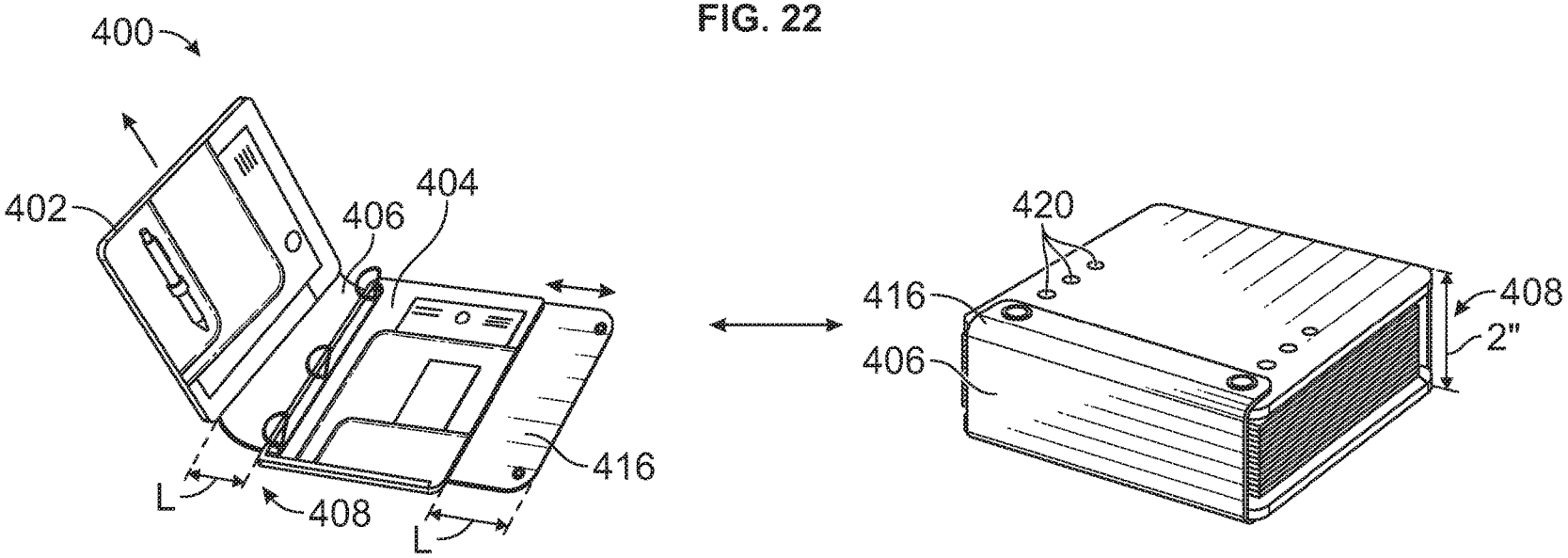
FIG. 23 is a perspective view similar to FIG. 22 showing the flexible spine member being slidably moved relative to the second panel to expand a width of the spine.

FIGS. 22 and 23 illustrate still another example expandable storage device 400 having a first panel 402, a second panel 404, and a spine member 406 forming a spine 408. The spine member 406 may be fixedly coupled to the first panel 402 and movably or slidably engaged with the second panel 404 to permit expansion of the storage device 400 as described hereinafter. As shown, each panel 402, 404 may include a variety of pockets such as pocket 410 having different shapes and sizes for storage of, for example, loose leaf paper. In addition, one or both of the panels 402, 404 may include a writing utensil holder such as an elastic band 412 and may also include a binding mechanism such as a three-ring binding 414 for attaching paper thereto. In some forms, the spine member 406 may be formed using a fabric or fabric blend material such that the spine member 406 is configured to be flexible.

An attachment end 416 of the spine member 406 may include one or more fastening members 418 configured to be coupled to the first panel 402 such that the expandable storage device 400 may be moved between the open configuration (illustrated left) and the closed configuration (illustrated right) to secure the contents therein. The attachment end 416 may be coupled to the first panel 402 in a variety of different manners, for example, the one or more fastening members 418 may include hook-and-loop fasteners such as Velcro®, clips, magnets, clasps, structures having inter-engaging geometries, cords, ties, or the like. In the illustrated form, the fastening members 418 are in the form of a snap configured to snap into one or more apertures 420 of the first panel 402.

Further, as described above, the flexible spine member 406 may be slidably or movably engaged with the second panel 404 such that the spine member 406 may be moved relative thereto. By one approach, the spine member 406 extends from the attachment end 416 with the fasteners 418 along the second panel 404 to at least an edge of the first panel 402 adjacent the spine 408. In one illustrative configuration, the spine member 406 extends through an elongate aperture or slot formed in the second panel 404, or an elongate aperture or slot formed on a side of the second panel 404, such that the spine member 406 may configured to slide therethrough in either lateral direction. In other forms, the spine member 406 may be slidably coupled a portion of the second panel 404 via an elastic flap or other like coupling. As shown in FIG. 22, the spine 408 of the expandable storage device 400 is of an example width 0.5L and the attachment end 416 is of an example width 1.5L. In some instances, a user may desire a spine 408 having a larger width to accommodate a larger number of articles or sheets within the expandable storage device 400. To do so, the user may slidably move the spine member 406 relative to the second panel 404 to increase the width of the spine 408 as shown in FIG. 23. So configured, the spine 408 may be increased to a width L, the attachment end 416 may be correspondingly decreased to a width L, and the one or more fastening members 418 on the attachment end 416 of the spine member 406 may be coupled to different selected apertures 420 on the first panel 402 to releasably close the device 400.

Figure 24:
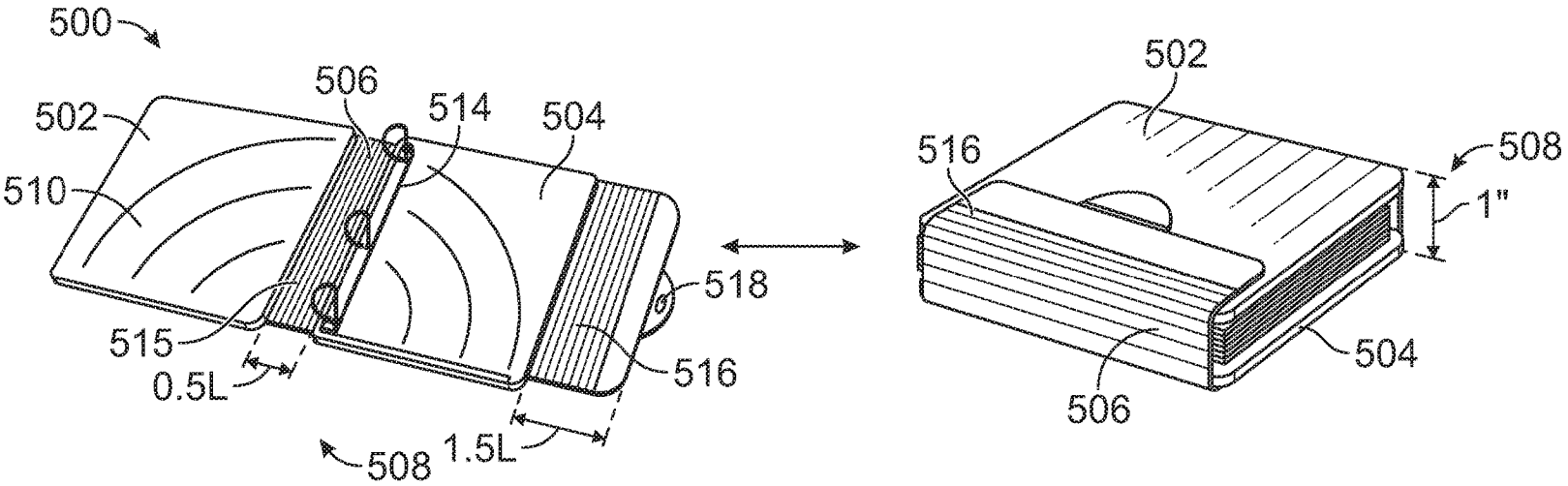
FIG. 24 is a perspective view of yet another example expandable storage device having a first panel and a second panel that is movable between an open configuration and a closed configuration, and showing a flexible spine member slidably engaged with the second panel.
Figure 25:
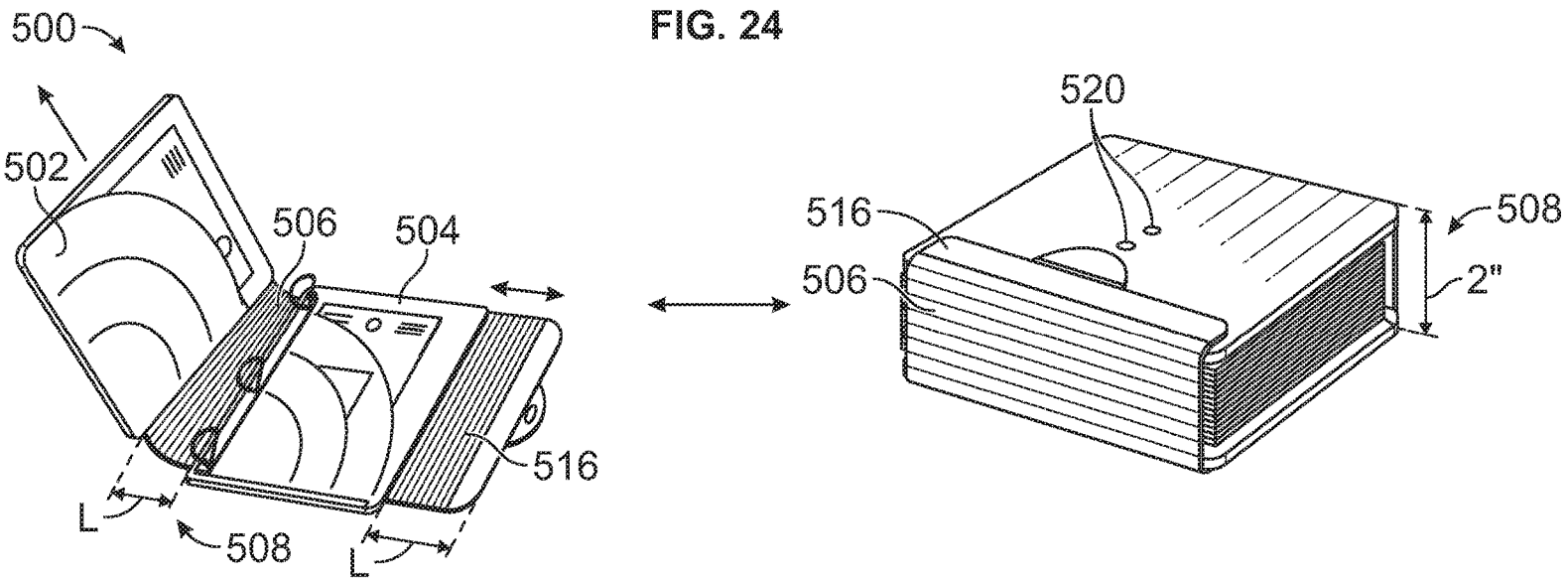
FIG. 25 is a perspective view similar to FIG. 24 showing the flexible spine member being slidably moved relative to the second panel to expand a width of the spine in the closed configuration.

FIGS. 24 and 25 illustrate still another expandable storage device similar to the expandable storage device described in FIGS. 22 and 23. Specifically, the example expandable storage device 500 includes a first panel 502, a second panel 504, and a spine member 506 forming a spine 508. The spine member 506 may be fixedly coupled to the first panel 502 and movably or slidably engaged with the second panel 504 to permit expansion of the storage device 500 as described hereinafter. As shown, each panel 502, 504 may include a variety of pockets such as pocket 510 having different shapes and sizes for storage of, for example, loose leaf paper. In addition, one or both of the panels 502, 504 may also include a binding mechanism such as a three-ring binding 514 for attaching paper thereto. As shown, the spine member 506 is formed of a plastic or polymer material and includes a flex area to permit flexing or bending thereof. For example, the flex area may include a plurality of transverse crease lines 515 extending along a width of the spine member 506 or areas of weakness formed therein. Such crease lines may be formed at least in part by perforating or slitting the panels.

An attachment end 516 of the spine member 506 may include one or more fastening members 518 configured to be coupled to the first panel 502 such that the expandable storage device 500 may be moved between the open configuration (illustrated left) and the closed configuration (illustrated right) to secure the contents therein. The attachment end 516 may be coupled to the first panel 502 in a variety of different manners, for example, the one or more fastening members 518 may include hook-and-loop fasteners such as Velcro®, clips, magnets, clasps, structures having inter-engaging geometries, cords, ties, or the like. In contrast with the embodiment shown in FIGS. 22 and 23, the attachment end 516 of the spine member 506 includes a single fastening member 518 configured to couple to a selected aperture of the plurality of apertures 520 on the first panel 502.

Further, as described above, the flexible plastic or polymer spine member 506 may be slidably or movably engaged with the second panel 504 such that the spine member 506 may be moved relative thereto. For example, the spine member 506 may extend through an elongate aperture or slot formed in the second panel 504, or an elongate aperture or slot formed on a side of the second panel 504, such that the spine member 506 may configured to slide therethrough in either lateral direction. In other forms, the spine member 506 may be slidably coupled a portion of the second panel 504 via an elastic flap or other like coupling. As shown in FIG. 24, the spine 508 of the expandable storage device 500 is of an example width 0.5L and the attachment end 516 is of an example width 1.5L. In some instances, a user may desire a spine 508 having a larger width to accommodate a larger number of articles or sheets within the expandable storage device 500. To do so, the user may slidably move the spine member 506 relative to the second panel 504 to increase the width of the spine 508 as shown in FIG. 25. So configured, the spine 508 may be increased to a width L, the attachment end 516 may be correspondingly decreased to a width L, and the one or more fastening members 518 on the attachment end 516 of the spine member 506 may be coupled to a different selected apertures 520 on the first panel 502 to releasably close the device 500.

Figure 26A:
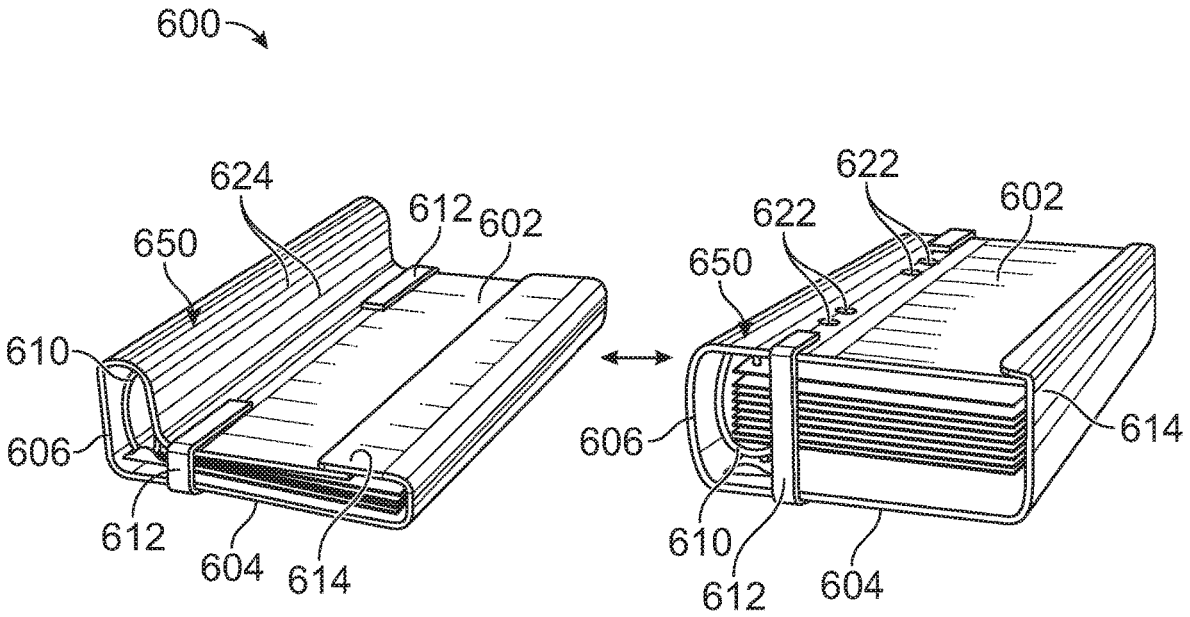
FIG. 26A is a perspective view of yet another example expandable storage device having a first panel and a second panel, the first panel having a flex area configured to accommodate articles of varying sizes, and showing an initial configuration with few of such articles and a second configuration with many of such articles.

FIG. 26A is a perspective view of yet another example expandable storage device 600 having a first panel 602, a second panel 604, and a spine 606. The expandable storage device 600 may be formed as a binder having a three-ring binding mechanism 610 positioned therein. The first panel 602 includes a flex area 650 configured to accommodate insertion of articles or sheets of varying sizes. For example, the flex area 650 may include a plurality of transverse crease lines 624 or areas of weakness formed therein, or alternatively, may be formed of a different material such as a thinner plastic sheet or fabric. Such crease lines may be formed at least in part by perforating or slitting the first panel 602. Additionally or alternatively, the second panel 604 may likewise include a flex area configured to permit the flexing or bending of various portions thereof.

As illustrated the device 600 may be configured to accommodate relatively few articles or sheets (illustrated left) or a larger number of articles or sheets (illustrated right). In the left, narrower configuration, the flex area 650 of the first panel 602 is configured to at least partially, flexibly wrap over the three-ring binding mechanism 610 such that an inner surface of the first panel 602 is proximate the sheets or articles contained in the device 600 and one or more straps 612 may be used to retain the first panel 602 in the generally L-shaped flexed configuration shown on the left side of FIG. 26A. For example, the straps 612 may include a fastening member for insertion into apertures 622 of the first panel 602. The articles contained in the device 600 in the narrow configuration are minimal such that the contour of the flex area 650 generally corresponds with a contour of the rings of the three-ring binding mechanism 610. Beneficially, the L-shaped configuration may permit several of such devices 600 to be stacked that the L-shaped configurations may nest partially within one another. In addition, the second panel 604 may include a closure flap 614 configured to be wrapped around and secured to the first panel 602 to inhibit accidental removal of the contents stored in the device 600. The closure flap 614 may at least partially overlap an outer surface of the first panel 602 and may be coupled thereto via various fastening method such as those provided herein.

If a user desires additional storage space within the device 600, the user may transition the device into the second configuration (illustrated right). As shown, the flex area 650 is no longer flexibly wrapping around and overlapping the three-ring binding mechanism 610 as there are a number of additional loose-leaf papers that are now coupled to the binding mechanism 610. Instead, the first panel 602 may be configured to lay substantially flat such that the device assumes a substantially rectangular profile and the one or more straps 612 may be coupled to different apertures 622 of the first panel 602 as shown. It is anticipated that there may still be some minor degree of flexing of the flex area 650 in the second illustrated configuration, but the first panel 602 may still be understood as laying substantially flat. It should be understood that the expandable storage device 600 may likewise be capable of a number of configurations of varying width between the two illustrated configurations based at least in part on the thickness of the contents therein. So configured, the first panel 602 is configured to flexibly expand as additional sheets or articles are added to the device 600 and retract as sheets or articles are removed.

Figure 26B:
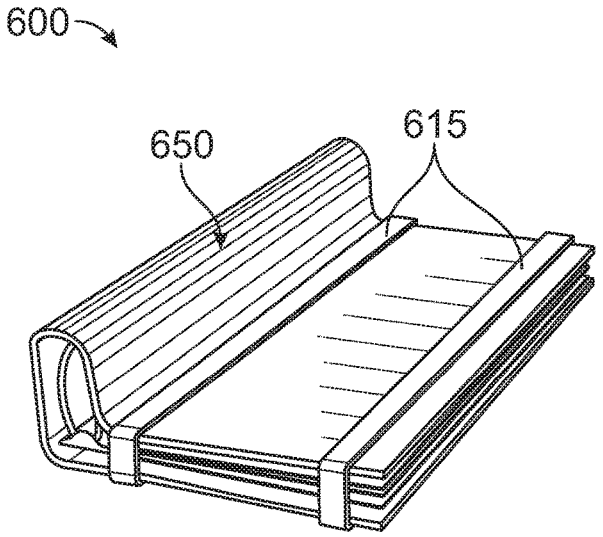
FIG. 26B is a perspective view of the expandable storage device of FIG. 26A having an elastic strap closure mechanism.

In addition, the expandable storage device 600 may alternatively be secured at the various different widths and configurations via one or more elastic straps 615 as shown in FIG. 26B. The elastic straps 615 may be removed to open the expandable storage device 600 to add additional articles or sheets, and the elastic straps 615 may be reattached to close the device 600. As additional papers or contents may be added within the device 600, the flex area 650 of the first panel 602 may gradually expand and flex less around the three-ring binding mechanism 610 such that variable storage configurations may be achieved. Additionally or alternatively, other closure mechanisms may be utilized for moving the device 600 between open and closed configurations.

Uses of singular terms such as "a," "an," are intended to cover both the singular and the plural, unless otherwise indicated herein or clearly contradicted by context. The terms "comprising," "having," "including," and "containing" are to be construed as open-ended terms. All methods described herein can be performed in any suitable order unless otherwise indicated herein or otherwise clearly contradicted by context. The use of any and all examples, or exemplary language (e.g., "such as") provided herein, is intended to illuminate the disclosure and does not pose a limitation on the scope of the disclosure. Any statement herein as to the nature or benefits of the disclosed device is not intended to be limiting. This invention includes all modifications and equivalents of the subject matter recited herein as permitted by applicable law. Moreover, any combination of the above-described elements in all possible variations thereof is encompassed by the disclosure unless otherwise indicated herein or otherwise clearly contradicted by context. No unclaimed language should be deemed to limit the invention in scope. Any statements or suggestions herein that certain features constitute a component of the claimed invention are not intended to be limiting unless reflected in the appended claims. Neither the marking of the patent number on any product nor the identification of the patent number in connection with any service should be deemed a representation that all embodiments described herein are incorporated into such product or service.

What is claimed is:

1. An expandable storage device comprising:

a first panel having a first panel spine portion, the first panel spine portion including a first aperture having a guide surface extending along at least a portion thereof;

a second panel coupled to the first panel, the second panel having a second panel spine portion; and a first actuator including an integral distal projection extending at least partially through the first aperture;

wherein the first spine portion and the second spine portion form a spine of the expandable storage device, the spine having a first width; and wherein movement of the first actuator in an axial direction is configured to cause the distal projection of the first actuator to at least partially engage with the guide surface of the first aperture to facilitate relative movement between the first panel and the second panel to expand or retract the spine between at least (i) the first width and (ii) a second width larger than the first width.

2. The expandable storage device of claim 1, wherein the first actuator is movable between a locked configuration and an unlocked configuration to selectively retain the spine at the first width or the second width.

3. The expandable storage device of claim 1, further comprising a second actuator including a distal projection extending at least partially through a second aperture of the second panel spine portion, the second aperture including a guide surface extending along at least a portion thereof;

wherein movement of the second actuator in a direction generally opposite the axial direction is configured to cause the distal projection of the second actuator to at least partially engage with the guide surface of the second aperture to facilitate relative movement between the first panel and the second panel to expand or retract the spine between at least (i) the first width and (ii) a third width larger than the first width.

4. The expandable storage device of claim 3, wherein movement of the first actuator is configured to facilitate movement of the first panel relative to the second panel, and wherein movement of the second actuator is configured to facilitate movement of the second panel relative to the first panel.

5. The expandable storage device of claim 4 wherein movement of both the first actuator and the second actuator together in generally opposing axial directions is configured to facilitate movement between the first panel and the second panel to expand or retract the spine between at least (i) the first width and (ii) a fourth width larger than the first width.

6. The expandable storage device of claim 1, wherein the first aperture is generally heart-shaped.

7. The expandable storage device of claim 1, wherein the expandable storage device is formed as one of a book, a binder, a filer, a notebook, a divider, a folder, and a composition book.

8. The expandable storage device of claim 1, further comprising a binding mechanism coupled to at least one of the first panel or the second panel.

9. The expandable storage device of claim 8, wherein the binding mechanism is one or a combination of a three-ring binding and a spiral wire binding.

10. An expandable storage device comprising:

a first panel having a first panel spine portion, the first panel spine portion including a first aperture having a guide surface extending along at least a portion thereof;

a second panel coupled to the first panel, the second panel having a second panel spine portion; and a first actuator including a distal projection extending at least partially through the first aperture;

wherein the first spine portion and the second spine portion form a spine of the expandable storage device, the spine having a first width; and wherein movement of the first actuator in an axial direction is configured to cause the distal projection of the first actuator to at least partially engage with the guide surface of the first aperture to facilitate relative movement between the first panel and the second panel to expand or retract the spine between at least (i) the first width and (ii) a second width larger than the first width;

wherein the first actuator is movable between a locked configuration and an unlocked configuration to selectively retain the spine at the first width or the second width; and wherein the first aperture includes at least two leg portions configured to engage with and receive at least a portion of the distal projection of the first actuator to inhibit lateral movement thereof, and wherein the locked configuration includes engagement between the distal projection and at least one of the at least two leg portions.

11. The expandable storage device of claim 10, further comprising a resilient member configured to bias the distal projection into engagement with at least one of the at least two leg portions of the first aperture.

12. An expandable storage device comprising:

a first panel having a first panel spine portion, the first panel spine portion including a first aperture having a guide surface extending along at least a portion thereof;

a second panel coupled to the first panel, the second panel having a second panel spine portion;

a housing covering at least a portion of the first panel spine portion and the second panel spine portion;

a first actuator including a distal projection extending at least partially through the first aperture, the first actuator extending through an opening of the housing;

wherein the first spine portion and the second spine portion form a spine of the expandable storage device, the spine having a first width; and wherein movement of the first actuator in an axial direction is configured to cause the distal projection of the first actuator to at least partially engage with the guide surface of the first aperture to facilitate relative movement between the first panel and the second panel to expand or retract the spine between at least (i) the first width and (ii) a second width larger than the first width.

13. An expandable storage device comprising:

a first panel including a first panel spine portion having a first plurality of apertures;

a second panel including a second panel spine portion having a second plurality of apertures;

a first actuator engaged with at least one of the first plurality of apertures; and a second actuator engaged with at least one of the second plurality of apertures;

wherein the first panel spine portion and the second panel spine portion form a spine of the expandable storage device, the spine having a first width;

wherein movement of the first actuator in a first axial direction is configured to facilitate relative movement between the first panel and the second panel to expand or retract the spine between at least (i) the first width and (ii) a second width greater than the first width; and wherein movement of the second actuator in a second axial direction generally opposite the first axial direction is configured to facilitate relative movement between the first panel and the second panel to expand or retract the spine between at least (i) the first width and (ii) a third width greater than the first width.

14. The expandable storage device of claim 13, wherein the second width is equal to the third width.

15. An expandable storage device comprising:

a first panel including a first panel spine portion having a first plurality of apertures, a second panel including a second panel spine portion having a second plurality of apertures, a first actuator engaged with at least one of the first plurality of apertures, and a second actuator engaged with at least one of the second plurality of apertures;

wherein the first panel spine portion and the second panel spine portion form a spine of the expandable storage device, the spine having a first width;

wherein movement of the first actuator in a first axial direction is configured to facilitate relative movement between the first panel and the second panel to expand or retract the spine between at least (i) the first width and (ii) a second width greater than the first width; and wherein movement of the second actuator in a second axial direction is configured to facilitate relative movement between the first panel and the second panel to expand or retract the spine between at least (i) the first width and (ii) a third width greater than the first width;

wherein the first actuator and the second actuator are movable between a locked configuration and an unlocked configuration to selectively retain the spine at the first width, the second width, or the third width.

16. An expandable storage device comprising:

a first panel including a first panel spine portion;

a second panel including a second panel spine portion, the second panel coupled to the first panel such that the second panel spine portion is at least partially superimposed over the first spine portion, the first and second panel spine portions forming a spine having a first width;

a first pair of actuators engaged with the first panel; and a second pair of actuators engaged with the second panel;

wherein movement of the first pair of actuators is configured to facilitate expansion or retraction of the spine between at least (i) the first width and (ii) a second width greater than the first width;

wherein movement of the second pair of actuators is configured to facilitate expansion or retraction of the spine between at least (i) the first width and (ii) a third width greater than the first width; and wherein movement of both the first pair of actuators and the second pair of actuators is configured to facilitate expansion or retraction of the spine between at least (i) the first width and (ii) a fourth width greater than the first width.

17. The expandable storage device of claim 16, wherein the second width is equal to the third width.

18. The expandable storage device of claim 16, wherein the first pair of actuators and the second pair of actuators are movable between a locked configuration and an unlocked configuration to selectively retain the spine at the first width, the second width, the third width, or the fourth width.

19. The expandable storage device of claim 18, further comprising at least one resilient member configured to bias the first pair of actuators and the second pair of actuators into the locked configuration.

* * * * *